US009803475B2

(12) United States Patent
Shahri et al.

(10) Patent No.: US 9,803,475 B2
(45) Date of Patent: Oct. 31, 2017

(54) SYSTEM AND METHOD FOR INTEGRATED WELLBORE STRESS, STABILITY AND STRENGTHENING ANALYSES

(71) Applicant: Weatherford/Lamb, Inc., Houston, TX (US)

(72) Inventors: Mojtaba P. Shahri, Houston, TX (US); Mohammadreza Safariforoshani, Houston, TX (US); Ovunc Mutlu, Houston, TX (US); Trevor Oar, Calgary (CA); Mojtaba Karimi, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 645 days.

(21) Appl. No.: 14/249,052

(22) Filed: Apr. 9, 2014

(65) Prior Publication Data

US 2015/0292323 A1 Oct. 15, 2015

(51) Int. Cl.
*E21B 49/00* (2006.01)
*E21B 21/00* (2006.01)

(52) U.S. Cl.
CPC ..... *E21B 49/006* (2013.01); *E21B 21/003* (2013.01); *E21B 49/003* (2013.01)

(58) Field of Classification Search
CPC ..... G01V 99/00; E21B 49/006
See application file for complete search history.

(56) References Cited

U.S. PATENT DOCUMENTS

2010/0282470 A1 11/2010 Alberty et al.
2011/0153296 A1 6/2011 Sadlier
2015/0168597 A1* 6/2015 Bai ..... G01V 99/00 703/10

FOREIGN PATENT DOCUMENTS

EP 2251524 A1 11/2010
WO 2012/170382 A1 12/2012
WO 2013/119685 A1 8/2013

OTHER PUBLICATIONS

Int'l Search Report and Written Opinion in counterpart PCT Appl. PCT/US2015/024887, dated Oct. 16, 2015, 10-pgs.
Aston, M. S., et al, "Drilling Fluids for Wellbore Strengthening", BP Exploration, IADC Drilling Conference, Mar. 2-4, 2004, IADC/SPE 87130, 8 pages.
Alberty, Mark W., "A Physical Model for Stress Cages", SPE 90493, Society fo Petroleum Engineers, Inc., Sep. 26-29, 8 pages.
(Continued)

*Primary Examiner* — Manuel Rivera Vargas
(74) *Attorney, Agent, or Firm* — Blank Rome, LLP

(57) ABSTRACT

Systems and methods for an integrated wellbore stress, stability and strengthening analysis are disclosed. An integrated geomechanical tool can be used to analyze and evaluate stress along the length of the wellbore to identify a safe drilling mud weight window and help identify troublesome zones in the wellbore. Fracture length may then be predicted in the identified troublesome zones by using a stress tensor calculated during the stress analysis. The calculated fracture length may be used to perform a strengthening analysis. After performing strengthening analysis, mud loss may be predicted based on predicted fracture size calculated during the stress, stability and strengthening analyzes.

36 Claims, 27 Drawing Sheets

(56) References Cited

OTHER PUBLICATIONS

Nguyen, Well Design—Spring 2013, New Mexico Well Design, PE 413, Chapter 1: Fracture Pressure, 2013, 44 pages.
Examination Report No. 1 in counterpart Austrailian Appl. 2015243844, dated Mar. 7, 2017, 4-pgs.
First Office Action in counterpart Canadian Appl. 2945044, dated Jul. 10, 2017, 4-pgs.

* cited by examiner

686

688

730

797

798

SYSTEM AND METHOD FOR INTEGRATED WELLBORE STRESS, STABILITY AND STRENGTHENING ANALYSES

TECHNICAL FIELD

This disclosure relates generally to the field of drilling wellbores and in particular to methods and systems for performing wellbore stress, stability and strengthening analyses.

BACKGROUND

In drilling of wells, drilling fluid is generally circulated through a drill string and drill bit and then back to the surface of the wellbore being drilled. At the surface, the fluid may be processed to remove solids and to maintain desired properties before it is recirculated back to the well. During drilling operations, some amount of this drilling fluid may be lost due to various factors. This loss of drilling fluid may be referred to as lost circulation. Lost circulation is one of the largest contributors to non-productive time in drilling operations. This is particularly true for wells being drilled in complex geological settings such as deep water or highly depleted zones/intervals. Thus, it is important to determine the causes of lost circulation and try to mitigate those factors.

One major factor contributing to lost circulation is the formation of fractures in the wellbore wall. The fractures provide an outlet for the drilling fluid to escape from and thus result in loss of fluids. Loss of circulation due to creation of fractures in the wellbore wall is a major problem in drilling operations, as it is costly and may result in loss of well control. Additionally, if left untreated, undesired fractures could threaten the integrity of the entire wellbore. To prevent or mitigate wellbore losses, an engineering practice referred to as wellbore strengthening may be conducted.

Wellbore strengthening can done using a variety of different techniques. One common wellbore strengthening technique involves sealing existing natural fractures or induced fractures with a lost circulation material, after they have been created. Sealing of fractures in wellbore strengthening generally occurs with materials having properties that are conducive to sealing of the wellbore wall. In general, to conduct a successful wellbore strengthening operation, the width of a fracture at the wellbore wall has to be determined. This allows accurately engineering a lost circulation material having a suitable particle size distribution that can seal the fracture at the wellbore wall.

While sealing of fractures after their formation may be appropriate in some cases, this technique may be less than ideal in other situations. For example, in some instances it may be more efficient to strengthen the wellbore wall such that undesired fractures do not form during drilling. Strengthening the wall may involve increasing the pressure at which an undesired fracture will form in the wellbore wall. The pressure at which a fracture will form generally corresponds to a property referred to as the fracture gradient.

One wellbore strengthening technique involves increasing the fracture gradient of the wellbore wall by intentionally inducing fractures that are then sealed. This has been shown to mitigate future fractures and hinder further fracture propagation. To create induced fractures, mud weight has been used to exert extra pressure on the formation. When pressure exerted by mud weight exceeds the fracture gradient of the wellbore at a particular point in the well, a fracture is created at that point. To control the size of the induced fracture and the increase in the fracture gradient, it may be important to know the precise amount of mud weight to use at a particular location.

To determine what strengthening technique to use for a given wellbore, areas of the wellbore that may be susceptible to fracture formation may first need to be identified and the mud weight at which a fracture may be formed in those areas may need to be determined. Still because of uncertainties associated with drilling operations, it may not always be easy to determine which wellbore strengthening technique to use for a given wellbore or what mud weight or lost circulation material would be the most effective. The following disclosure addresses these and other issues.

SUMMARY

In one embodiment, the inventive concept provides a non-transitory program storage device, readable by a processor and comprising instructions stored thereon that causes one or more processors to receive a plurality of input parameters, each input parameter relating to a wellbore, and to generate a geomechanical model of the wellbore based on one or more of the received input parameters. The instruction may further cause the processor(s) to perform a stress and stability analysis for the wellbore based on one or more of the received input parameters to produce one or more stress and stability analysis output parameters, and to perform a strengthening analysis for the wellbore based on one or more of the received input parameters and one or more of the stress and stability analysis output parameters to produce one or more strengthening analysis output parameters. Additionally, the instruction may cause the processor(s) to perform a mud loss analysis for the wellbore based on one or more of the received input parameters and one or more of the strengthening analysis output parameters to produce one or more mud loss analysis output parameters. Moreover, the instruction may cause the processor(s) to update a mud weight window for the wellbore based on one or more of the strengthening analysis output parameters.

In another embodiment, the inventive concept provides a method for analyzing wellbore stress, stability, strengthening and mud loss, where the method comprises receiving a plurality of input parameters, each input parameter relating to a wellbore, generating a geomechanical model of the wellbore based on one or more of the received input parameters, and performing a stress and stability analysis for the wellbore based on one or more of the received input parameters to produce one or more stress and stability analysis output parameters. The method may further comprise performing a mud loss analysis for the wellbore based on one or more of the received input parameters and one or more of the strengthening analysis output parameters to produce one or more mud loss analysis output parameters and updating mud weight window for the wellbore based on one or more of the strengthening analysis output parameters.

In yet another embodiment, the inventive concept provides a system for which includes a memory, a display device and a processor operatively coupled to the memory and the display device and adapted to execute program code stored in the memory to receive a plurality of input parameters, each input parameter relating to a wellbore, to generate a geomechanical model of the wellbore based on one or more of the received input parameters, to perform a stress and stability analysis for the wellbore based on one or more of the received input parameters to produce one or more stress and stability analysis output parameters, to perform a strengthening analysis for the wellbore based on one or more of the received input parameters and one or more of the stress and stability analysis output parameters to produce one or more strengthening analysis output parameters, and to perform a mud loss analysis for the wellbore based on one or more of the received input parameters and one or more of the strengthening analysis output parameters to produce one or more mud loss analysis output parameters. The processor may further be adapted to update a mud weight window for the wellbore based on one or more of the strengthening analysis output parameters.

DESCRIPTION OF DISCLOSED EMBODIMENTS

Figure 1:
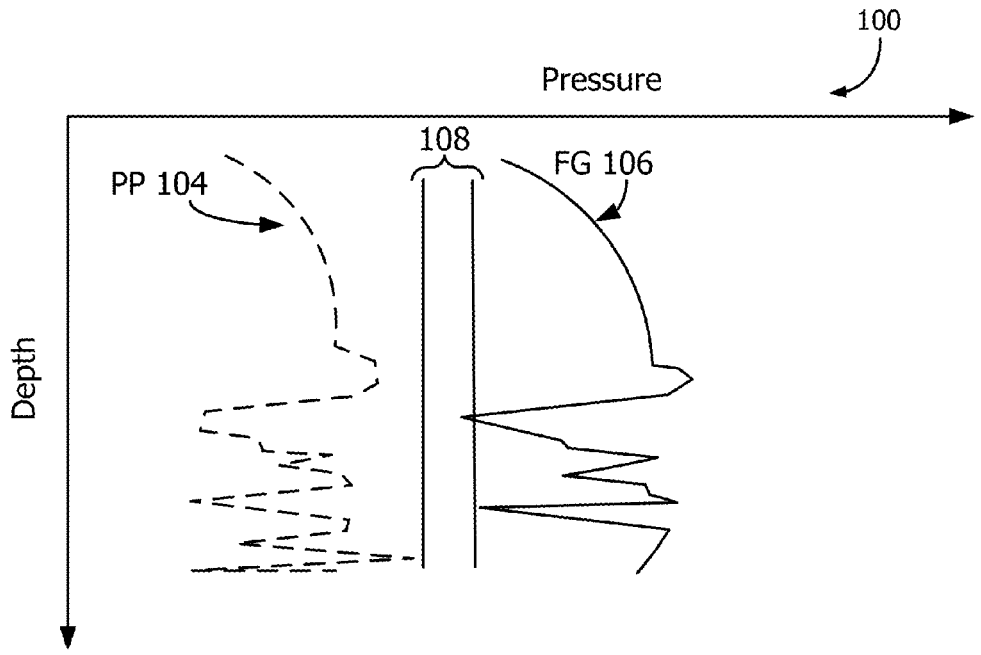
FIG. 1 is a graph of depth versus pressures and fracture gradient during drilling of a wellbore, according to one or more disclosed embodiments.

In the following description, for purposes of explanation, numerous specific details are set forth in order to provide a thorough understanding of the inventive concept. As part of this description, some of this disclosure's drawings represent structures and devices in block diagram form in order to avoid obscuring the invention. Reference in this disclosure to "one embodiment" or to "an embodiment" means that a particular feature, structure, or characteristic described in connection with the embodiment is included in at least one embodiment of the invention, and multiple references to "one embodiment" or "an embodiment" should not be understood as necessarily all referring to the same embodiment.

It will be appreciated that in the development of any actual implementation (as in any development project), numerous decisions must be made to achieve the developers' specific goals (e.g., compliance with system- and business-related constraints), and that these goals will vary from one implementation to another. It will also be appreciated that such development efforts might be complex and time-consuming, but would nevertheless be a routine undertaking for those of ordinary skill in the art of data processing having the benefit of this disclosure.

Various factors can affect the formation of a fracture in a wellbore. One of the most important of these factors may be the fracture gradient of the wellbore. Fracture gradient is proportional to the amount of pressure a specific location or region of the wellbore wall is able to sustain before a fracture is formed there, and can be calculated by this pressure divided by the depth of the well at that location. The amount of fracture gradient is often a function of several factors, including but not limited to mechanical properties of the formation, pore pressure, wellbore trajectory, depth, and far-field in-situ stress state/regime. While the fracture gradient in many wells will be generally linear and increasing with depth, in other wells the fracture gradient may vary dramatically because of formation properties and pore pressure variation.

The amount of pressure required for creating a fracture in the formation corresponds to the stresses around the wellbore. This stress may be caused by the weight of the rock surrounding the formation and the fluid pressure above the particular depth in the wellbore. The amount of stress can also be affected by properties of the rock as the stress that is generated by a specific weight can vary with rock properties. Because weight and rock properties generally vary from one region of the wellbore to another, the fracture gradient often varies along the length of the wellbore. As a result, fractures and corresponding drilling fluid losses may occur in particular regions of the wellbore where the fracture gradient is lower, while other regions of the wellbore may see no losses. Fracture gradient determines the upper limit of mud weight window. On the other hand, the lower limit of mud weight window is defined as pore pressure or collapse pressure depending on their relative values.

The main factor behind the pressure that induces a fracture in a wellbore is the pressure applied on the wellbore wall by the drilling fluid being circulated in the wellbore. The amount of this pressure generally corresponds directly with the drilling fluid's mud density or weight. Mud weight can be expressed as mass per unit volume, e.g., pounds per gallon (ppg) and is generally the density that an amount of fluid must have to exert a given gradient of pressure for safe drilling procedures.

During drilling operations when drilling fluid is being circulated, additional pressure is generally applied against the wellbore wall caused by friction-induced pressure drop. Thus, in addition to mud density, drilling operations often take into account the equivalent circulating density (ECD) of a drilling fluid. The ECD is generally equal to the dynamic pressure drop from a particular location of the wellbore to the surface, plus the static head of the fluid caused by its density. In general, to maintain safe drilling procedures and prevent undesired fractures from forming in the wellbore wall, the ECD pressure needs to be maintained in between the pore pressure and fracture gradient of the wellbore at any given location. This is shown in FIG. 1.

FIG. 1 illustrates a graph showing pore pressure and fracture gradients of an exemplary wellbore as the depth of the wellbore increases. As can be seen, the ECD 108 is generally selected such that it is kept in between the pore pressure PP 104 and fracture gradient FG 106 lines. In some instances, formation collapse pressure (CP) might be higher than formation pore pressure (PP). In these conditions, the lower limit of mud weight window, PP, should be substituted with the formation collapse pressure. In some wells, such as the one referenced in FIG. 1, the value of ECD 108 may vary within a certain range without crossing either the PP 104 or the FG 106. This range corresponds with a certain range of mud weight which may be referred to as the safe mud weight window. Because of low fracture gradient in certain regions of the well, the safe mud weight window may be too narrow at certain locations. In these locations, ECD line 108 may have to cross one of the pressure lines 104 or FG 106. Fractures are highly likely to occur at locations where the ECD line 108 crosses the FG line 106. At locations where the ECD line 108 crosses the pore pressure line 104, well control (kick) or collapse problems may occur. Thus, it is important to accurately predict the safe mud weight window and to determine at what locations, if any, the safe mud weight window may be too narrow. At such locations, it is important to predict the length and width of induced fractures likely to form and to determine what strengthening techniques may best address any such fractures either by preventing them from forming or by sealing them once they are formed to mitigate further propagation.

Historically, predicting the safe mud weight window has been done by using time-independent models, most of which are based on linear theory of elasticity. Such models do not take into account transient temperature and mud cake (pore pressure) effects during drilling operations. Mud temperature and mud cake effects can change the stress distribution around the wellbore and thus directly affect the safe mud weight window. As a result, predictions provided by such models may be imprecise or inaccurate. Moreover, wellbore strengthening can be achieved before fracture initiation by taking into account mud temperature and internal/external mud cake effects. This can be done, for example, by optimizing operational parameters affecting the wellbore temperature or internal/external mud cake properties to strengthen the wellbore, thus preventing fracture initiation. Additionally, for situations in which preventing fracture formation is impossible or impracticable, a determination of which wellbore strengthening technique to use after fracture initiation may be advantageous in providing the best solution possible for each given situation. Such a determination may be made by analyzing various wellbore strengthening techniques using an advanced analytical model. These and other advantages may be provided in embodiments disclosed herein.

In one embodiment, the disclosed solution provides an integrated geomechanical tool that analyzes and evaluates stress along the length of a wellbore to determine stability and identify troublesome zones for wellbore strengthening applications. The integrated geomechanical tool may incorporate transient thermo-poro-elastic algorithms which take into account wellbore temperature and/or internal/external mud cake effects. Utilizing a fully transient thermo-poro-elastic model, the external/internal mud cake and temperature effects on the near-wellbore stresses may be quantified. The tool may also simulate various wellbore strengthening scenarios based on induced fracture width and length using analytical solutions. Additionally, the tool may use the stress distribution around the wellbore obtained from the transient thermo-poro-elastic models to find a stable fracture length and width. The integrated tool may also provide a suitable mechanism for designing Lost Circulation Materials (LCM) and help achieve customized strengthening approaches when drilling through depleted zones.

In one embodiment, the integrated tool may include steps for one or more of the following: 1) generating a geomechanical model for the wellbore based on input data from different sources such as well-logs, leak-off tests, mini-fracture tests, and the like; 2) determining the complete stress tensor around the wellbore based on a transient thermo-poro-elastic model which may include internal/external mud cake effects; 3) determining the drilling safe mud weight window based on various failure criteria; 4) identifying troublesome zones with narrow mud weight window throughout the well trajectory; 5) performing an integrated wellbore strengthening analysis based on different mechanisms (e.g., induced fracture plugging, temperature, external and internal mud cake effects, etc.); 6) performing an integrated mud loss volume prediction using different mechanisms (e.g., natural fracture loss, induced fracture loss, formation loss, etc.); and 7) quantifying the amount of strengthening and re-generating mud weight window for safe drilling.

Figure 2:
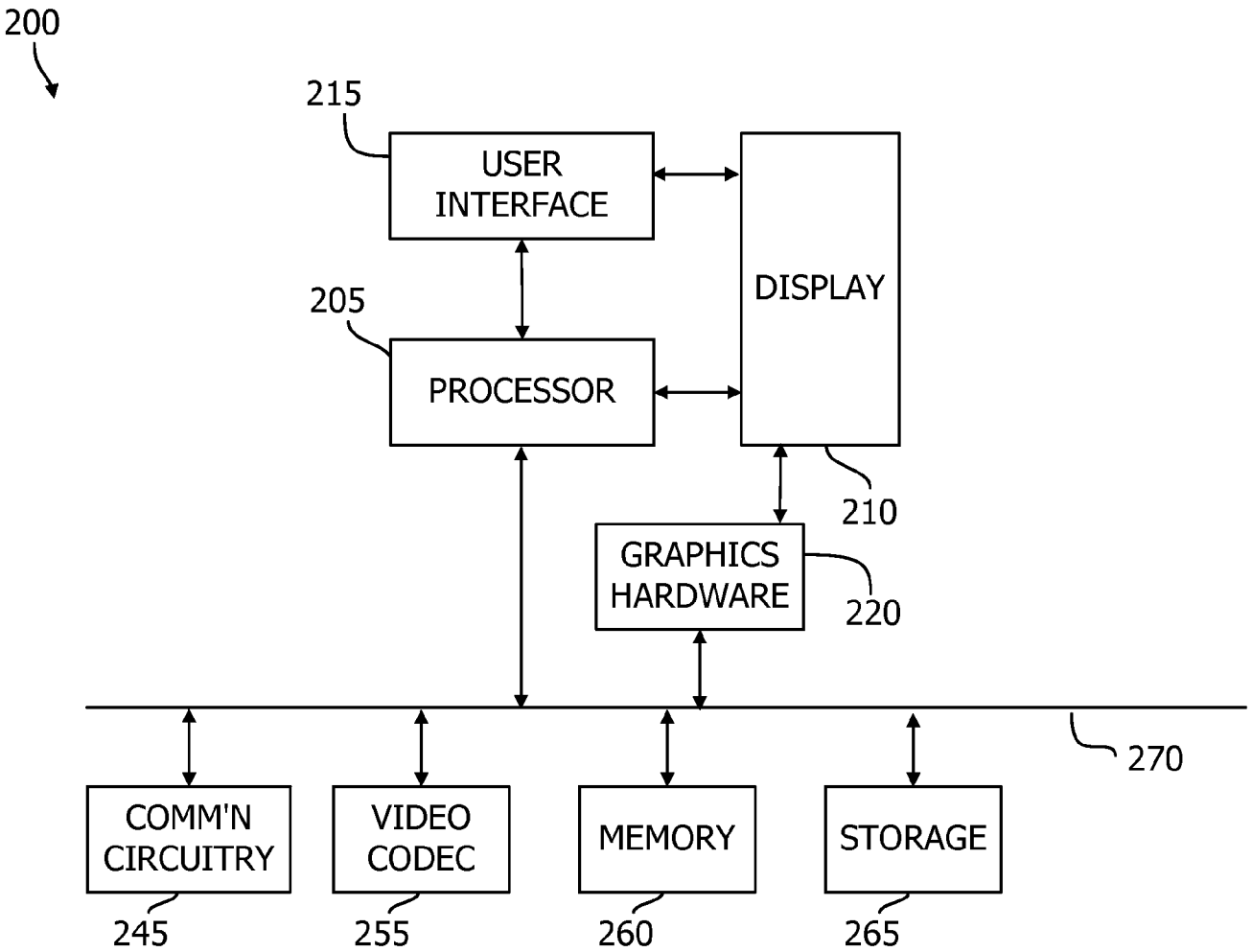
FIG. 2 is an illustrative computing device, according to one or more disclosed embodiments.

In one embodiment, the integrated tool can be implemented as a software program accessible by a user using a computing device. FIG. 2 provides a simplified functional block diagram of an illustrative computing device 200 according to one embodiment. Computing device 200 may include processor 205, display 210, user interface 215, graphics hardware 220, communications circuitry 245, memory 260, storage 265, and communications bus 270. Computing device 200 may be, for example, a laptop, desktop, tablet computer, a personal digital assistant (PDA), mobile telephone, server, or notebook. More particularly, the disclosed techniques may be executed on a device that includes some or all of the components of device 200.

Processor 205 may execute instructions necessary to carry out or control the operation of many functions performed by device 200. Processor 205 may, for instance, drive display 210 and receive user input from user interface 215. User interface 215 can take a variety of forms, such as a button, keypad, dial, a click wheel, keyboard, display screen and/or a touch screen. Processor 205 may also, for example, be a system-on-chip such as those found in mobile devices and include a dedicated graphics processing unit (GPU). Processor 205 may be based on reduced instruction-set computer (RISC) or complex instruction-set computer (CISC) architectures or any other suitable architecture and may include one or more processing cores. Graphics hardware 220 may be special purpose computational hardware for processing graphics and/or assisting processor 205 to process graphics information. In one embodiment, graphics hardware 220 may include a programmable graphics processing unit (GPU).

Memory 260 may include one or more different types of media used by processor 205 and graphics hardware 220 to perform device functions. For example, memory 260 may include read-only memory (ROM), and/or random access memory (RAM). Storage 265 may store computer program instructions or software, preference information, device profile information, and any other suitable data. Storage 265 may include one or more non-transitory storage mediums including, for example, magnetic disks (fixed, floppy, and removable) and tape, optical media such as CD-ROMs and digital video disks (DVDs), and semiconductor memory devices such as Electrically Programmable Read-Only Memory (EPROM), and Electrically Erasable Programmable Read-Only Memory (EEPROM). Memory 260 and storage 265 may also be used to tangibly retain computer program instructions or code organized into one or more modules and written in any desired computer programming language. When executed by, for example, processor 205 such computer program code may implement one or more of the operations described herein.

Figure 3:
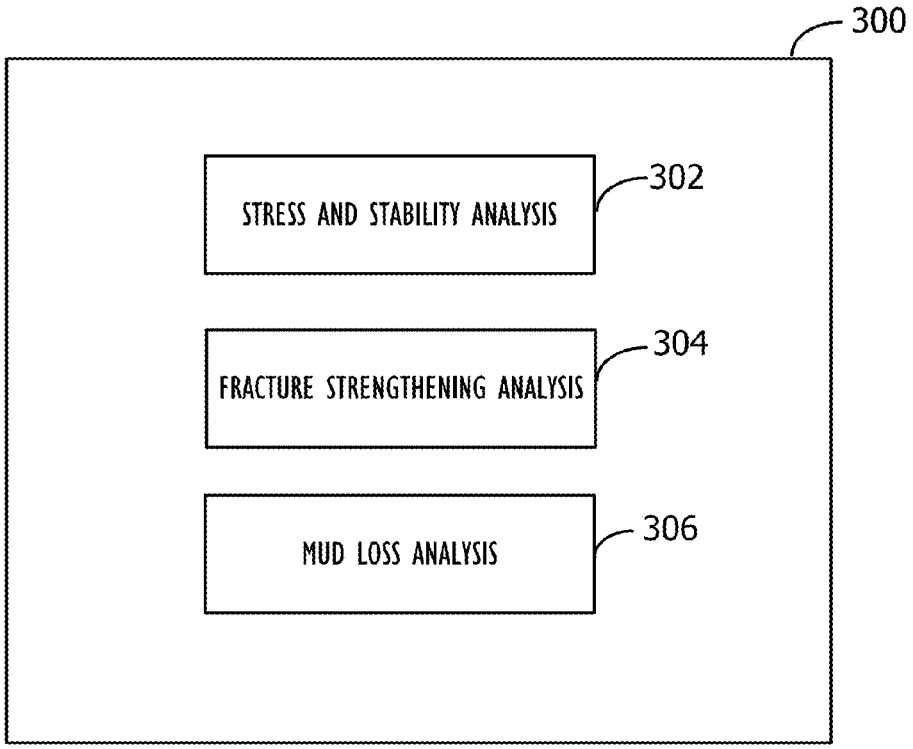
FIG. 3 is an illustrative user interface for selecting a wellbore analysis, according to one or more disclosed embodiments.

In one embodiment, an integrated tool for integrated wellbore stress, stability and strengthening analysis may provide one or more user interfaces for a user to choose which analysis to perform, to enter input data and to view outputs. A user interface for selecting which analysis to perform is illustrated in FIG. 3. As shown, in one embodiment, a user interface screen 300 may provide a button 302 for running a stress and stability analysis, a button 304 for selecting a fracture strengthening analysis and a button 306 for performing a mud loss analysis.

Performing a stress analysis may involve determining the stress tensor of the wellbore by using transient thermo-poro-elastic model based on various input parameters which may include internal/external mud cake effects. The fracture strengthening analysis, on the other hand, may involve performing an integrated wellbore strengthening analysis based on different strengthening techniques and based on the stress tensor obtained from the stress analysis. Strengthening analysis may involve recalculating fracture gradient and updating mud weight window based on the amount of strengthening. The mud loss analysis may provide an accurate estimation of loss of fluids into natural, formation pore space or induced fractures predicted to occur in the wellbore.

Although shown as individual analyses, it should be understood that a user can select to perform all three of the analyses by coming back to this screen after a previous one has been performed. Alternatively, the tool may perform an integrated analysis by running two or more options at the same time.

Figure 4A:
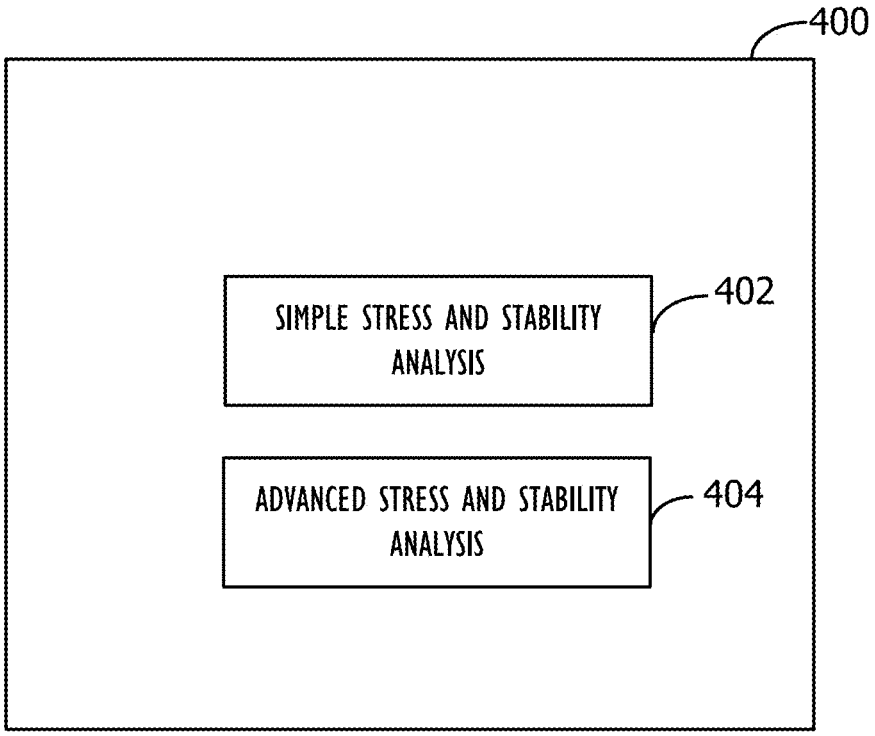
FIGS. 4A-4C are illustrative user interfaces for running a wellbore stress and stability analysis, according to one or more disclosed embodiments.

Selecting the stress analysis option, in one embodiment, may take the user to the user interface screen 400 of FIG. 4A, where a selection can be made between a simple stress analysis 402 and an advanced stress analysis 404. Choosing the simple stress analysis 402 may take the user to the input screen 410 of FIG. 4B to enter various input parameters. These input parameters are chosen to provide data that may directly or indirectly effect fracture gradient or collapse pressure of the wellbore. The parameters include, in one embodiment, parameters relating to well data, well location (e.g., onshore or offshore), formation pressures and stresses, rock mechanical properties, fluid penetration properties and/or steady-state thermal effects.

User screen 410 may provide text boxes for entering data for each of these parameters. In one embodiment, the entered data may need to be a number for one or more of the parameters. In another embodiment, the data may be entered as a range of numbers for one or more parameters. This may be done, for example, when there are uncertainties in the value of the input parameters. In such a case, a range of values representing a minimum and a maximum value may be input instead of exact values, and a statistical analysis, such as the Monte-Carlo algorithm, may be performed to obtain the outputs. In yet another embodiment, the screen may provide drop down boxes for one or more of the parameters, where the user can select one option from a range of options provided. Any other method of allowing for entering an input value for a parameter or selecting one from a choice of selections may be used.

The parameters include, in one embodiment, depth of interest 412, well azimuth 414, well inclination 416, borehole diameter 418, well location 420, Kelly Bushing height (relative to ground level) 422, azimuth of maximum horizontal stress 424, vertical stress gradient 426, maximum horizontal stress gradient 428, minimum horizontal stress gradient 430, formation pressure gradient 432, wellbore pressure 434, peak cohesion 436, peak friction angle 438, Poisson's ratio 440, Young's modulus 442, tensile strength 444, Biot's coefficient 446, thermal expansion coefficient 448, wellbore temperature 450, formation temperature 452, filter cake efficiency 454, and fluid penetration coefficient 456. These input parameters are known in the art and will not be explained in detail here. Values for these input parameters may be obtained from different sources such as well logs, leak-off tests, mini-fracture tests, and the like. These values may be obtained real-time for the well being drilled or may be obtained pre-drill from other wells nearby. If a value is not available for one or more of the parameters or is not entered, the tool may assume a value based on available data and information.

Figure 4B:
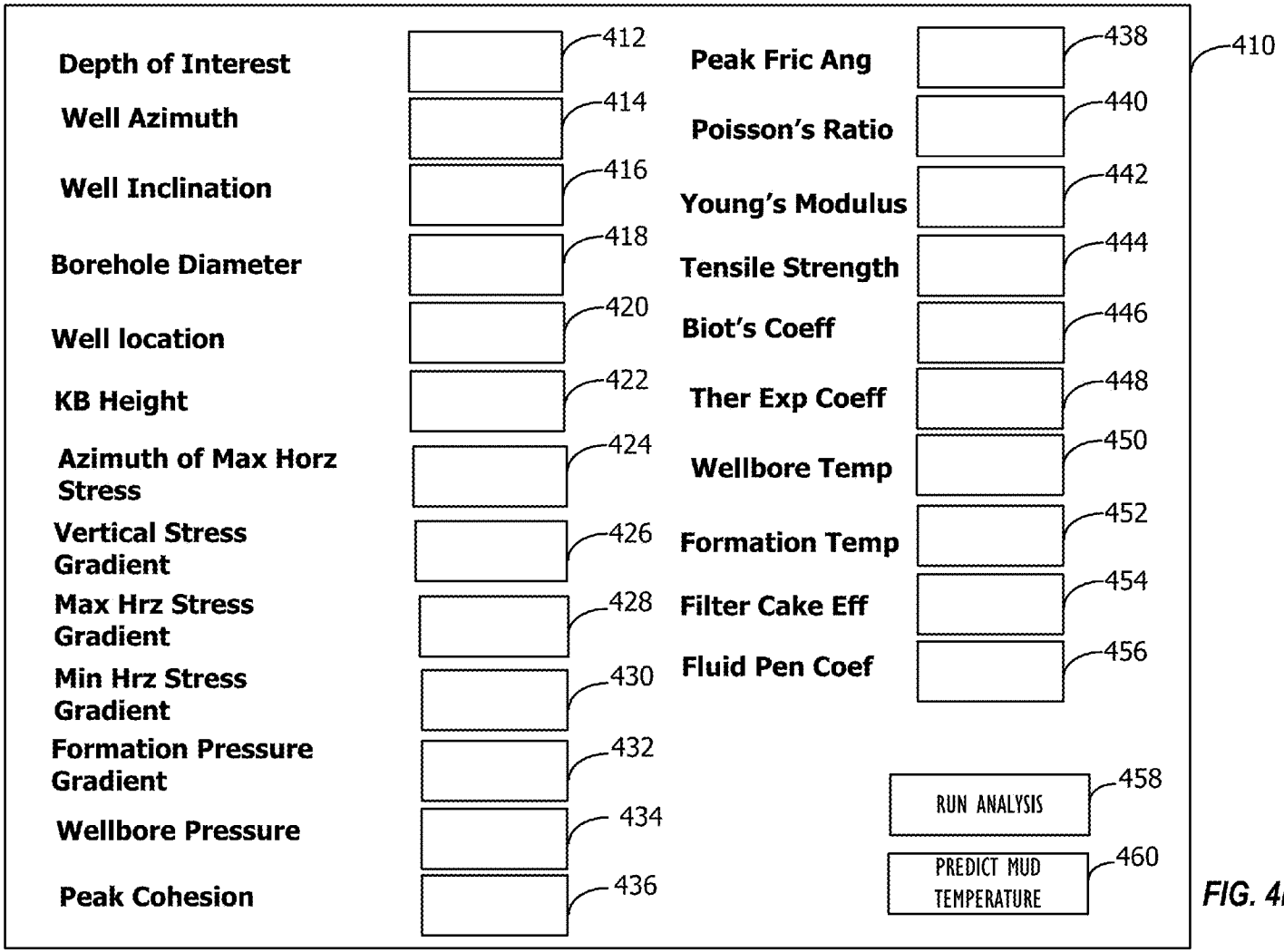

The input parameters are chosen to provide detail information about the formation and conditions surrounding the drilling operation to enable the tool to run a thorough analysis using geomechanical models and determine the complete stress tensor of the wellbore. As such, the input parameters shown in FIG. 4B are merely exemplary. Some of these parameters may not be used in alternative embodiments, while others may be replaced by new parameters not mentioned here. Additional parameters may also be added to this list in other embodiments. In practice, any parameter that affects the stress tensor of the wellbore may be used.

Once all available and desired input parameters have been entered, the user may click on the run analysis button 458 to start the analysis. Choosing to run the analysis may take the user to an output screen 464, where a graph 466 illustrating wellbore pressures and mud weight window along the wellbore length may be presented. Graph 466 illustrates pore pressure 468, fracture gradient 470 and ECD line 472 along the length of the analyzed wellbore assuming pore pressure is higher than predicted collapse pressure. Pore pressure is generally known and entered as an input for the analysis, while the analysis calculates fracture gradient and collapse pressure and determines the mud weight safe window based on relative values of collapse pressure, pore pressure, fracture pressure and/or minimum in-situ stress.

By illustrating PP 468 and FG 470, the graph 466 can help identify troublesome areas of the wellbore where the safe mud weight window may be too narrow, the ECD 472 has to cross FG 470 line, and thus areas where absent performing some strengthening operation, fractures are likely to occur. For example, graph 466 illustrates that at areas identified by circles 474 and 476, the ECD line 472 has to cross FG 470. For such areas, in one embodiment, the integrated solution may provide an option for the user to enter a value for ECD and determine if a fracture is likely to occur. In such a case, the integrated solution may determine the stable fracture length and width for wellbore strengthening applications by using the complete stress tensor obtained from the stress analysis.

Figure 5A:
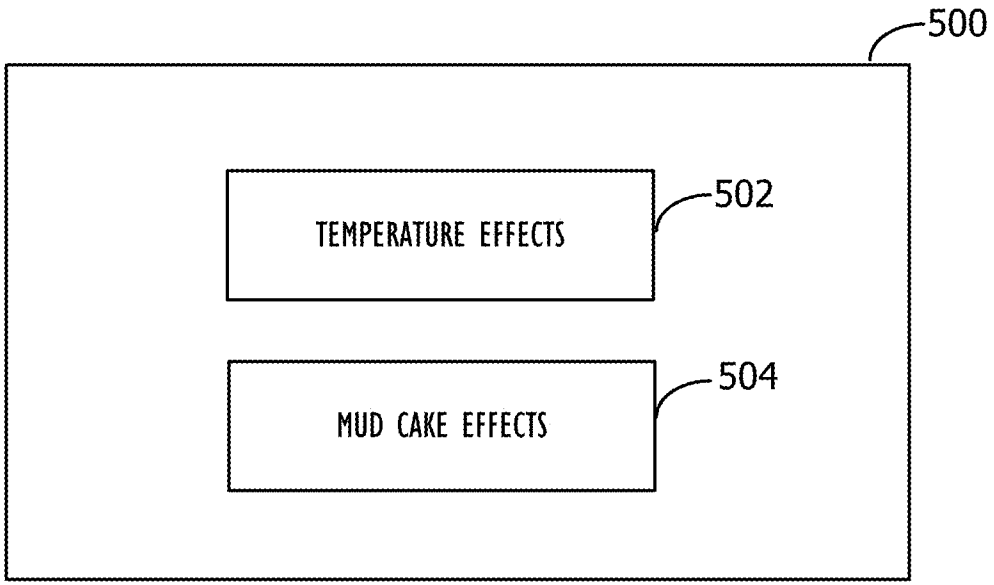
FIGS. 5A-5D are illustrative user interfaces for running an advanced wellbore stress and stability analysis, according to one or more disclosed embodiments.

The user can review the graph and decide that this wellbore does not require a wellbore strengthening operation in which case there may not be a need for any further analysis. Alternatively, the user may decide to run a fracturing strengthening analysis or may choose to perform an advanced stress analysis before running a strengthening analysis. To run an advanced stress analysis, the user may go back to screen 400 of FIG. 4A to select the advanced stress analysis button 404. Upon selecting the advanced stress analysis button 404, the user may be taken to the user interface screen 500 of FIG. 5A to choose between performing an advanced stress analysis which takes into account temperature effects 502 or performing one that takes into account mud cake effects 504. Alternatively, an option may be presented that takes into account both temperature and mud cake effects.

Figure 5B:
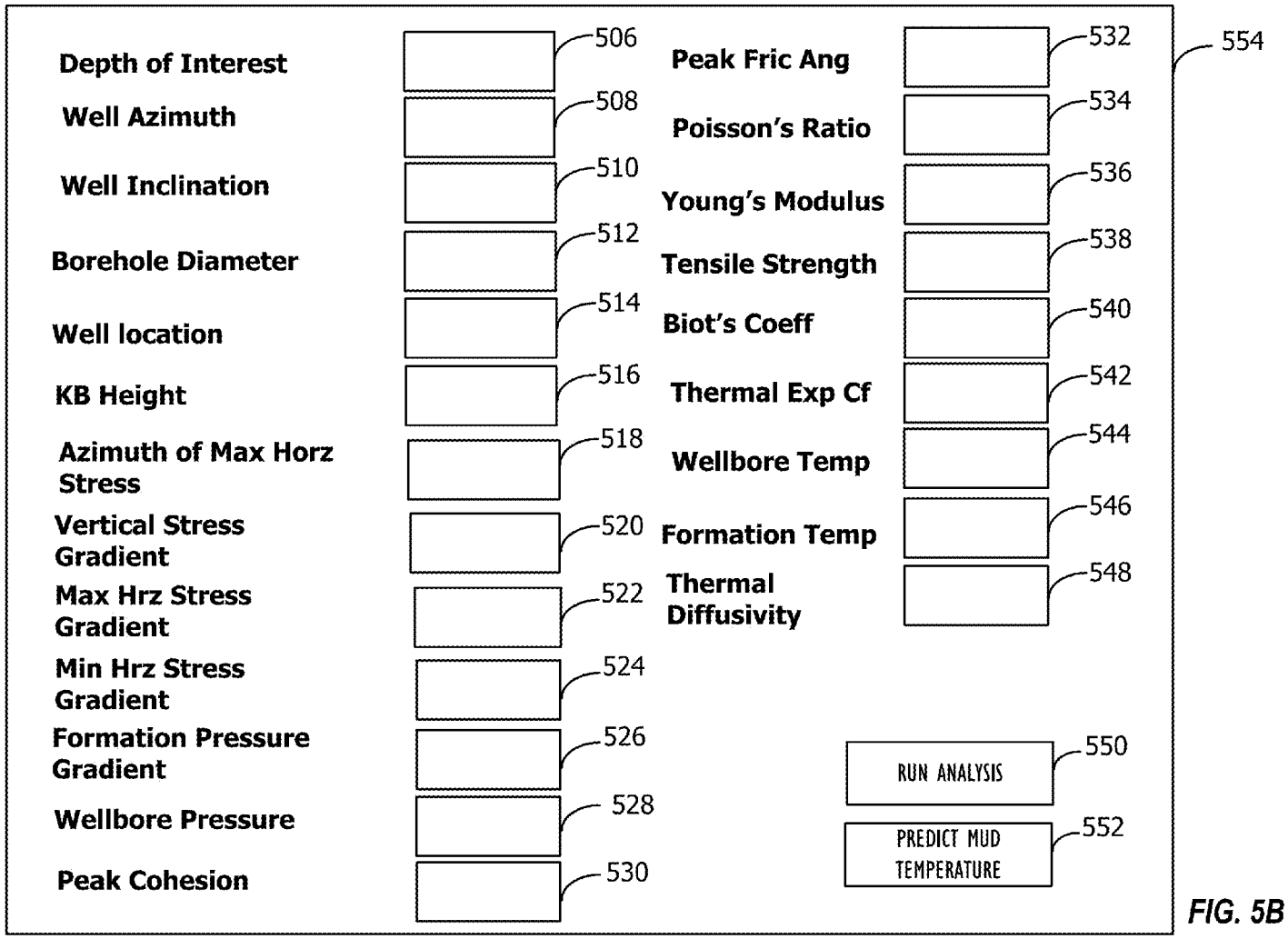

When temperature effects 502 is selected in screen 500, input screen 554 of FIG. 5B may be presented to the user to prompt the user to enter values for a variety of parameters. The parameter list for performing an advanced stress analysis which takes into account temperature effects includes, in one embodiment, depth of interest 506, well azimuth 508, well inclination 510, borehole diameter 512, well location 514, Kelly Bushing height (relative to ground level) 516, azimuth of maximum horizontal stress 518, vertical stress gradient 520, maximum horizontal stress gradient 522, minimum horizontal stress gradient 524, formation pressure gradient 526, wellbore pressure 528, peak cohesion 530, peak friction angle 532, Poisson's ratio 534, Young's modulus 536, tensile strength 538, Biot's coefficient 540, thermal expansion coefficient 542, wellbore temperature 544, formation temperature 546, and thermal diffusivity 548. It should be noted that most of these parameters overlap with parameters presented on input screen 410 of FIG. 4B for performing a simple stress analysis. In general the method used in the advanced stress analysis may be similar to the one used for the simple stress analysis with similar parameters used, but the simple analysis is generally independent of time, while the advanced analysis is time-dependent. As temperature may change on a real time basis, the advanced analysis may be time dependent and may be performed during the drilling operation by inputting the correct temperature at a given point in time. The correct temperature may be measured during the drilling operation using real time measurement devices employed in the wellbore or can be predicted as described later.

In one embodiment, the analysis quantifies the effects of each of the parameters included in screen 554 separately, analyzing each parameter's effect on the wellbore.

In one embodiment, when the user enters values for a parameter for one type of analysis, the values for such parameter will automatically be filled in text boxes used for the same parameter in different analyses. For example, if the user already provided data for well azimuth 414 in FIG. 4B, the value entered may automatically be filled in box 508. Alternatively, the program may block box 508 to show that data has already been provided for this parameter.

Figure 4C:
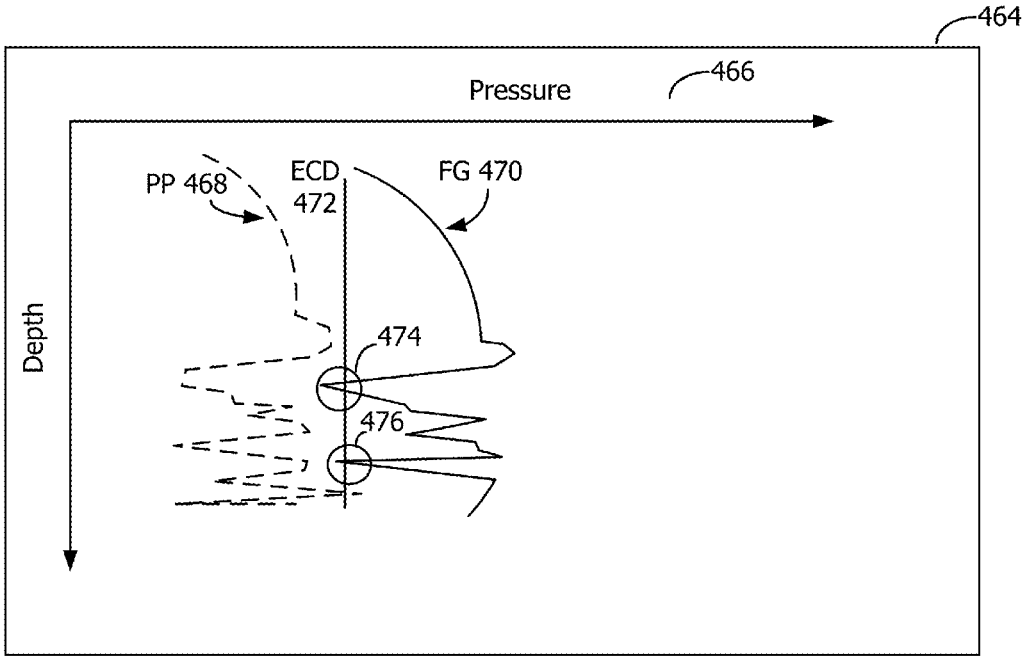

Once data has been entered for all available parameters, the user may select to run the analysis by choosing the run analysis button 550 or for cases in which mud temperature is not known, the user may decide to predict the mud temperature by pressing the predict mud temperature button 552. Choosing to run the analysis may take the user to an output screen similar to output screen 464 of FIG. 4C where a graph of well depth versus pressures presents the safe drilling mud weight window and identifies potential problem areas. The same mud temperature prediction can be performed by selecting button 460 in simple stress analysis.

Figure 5C:
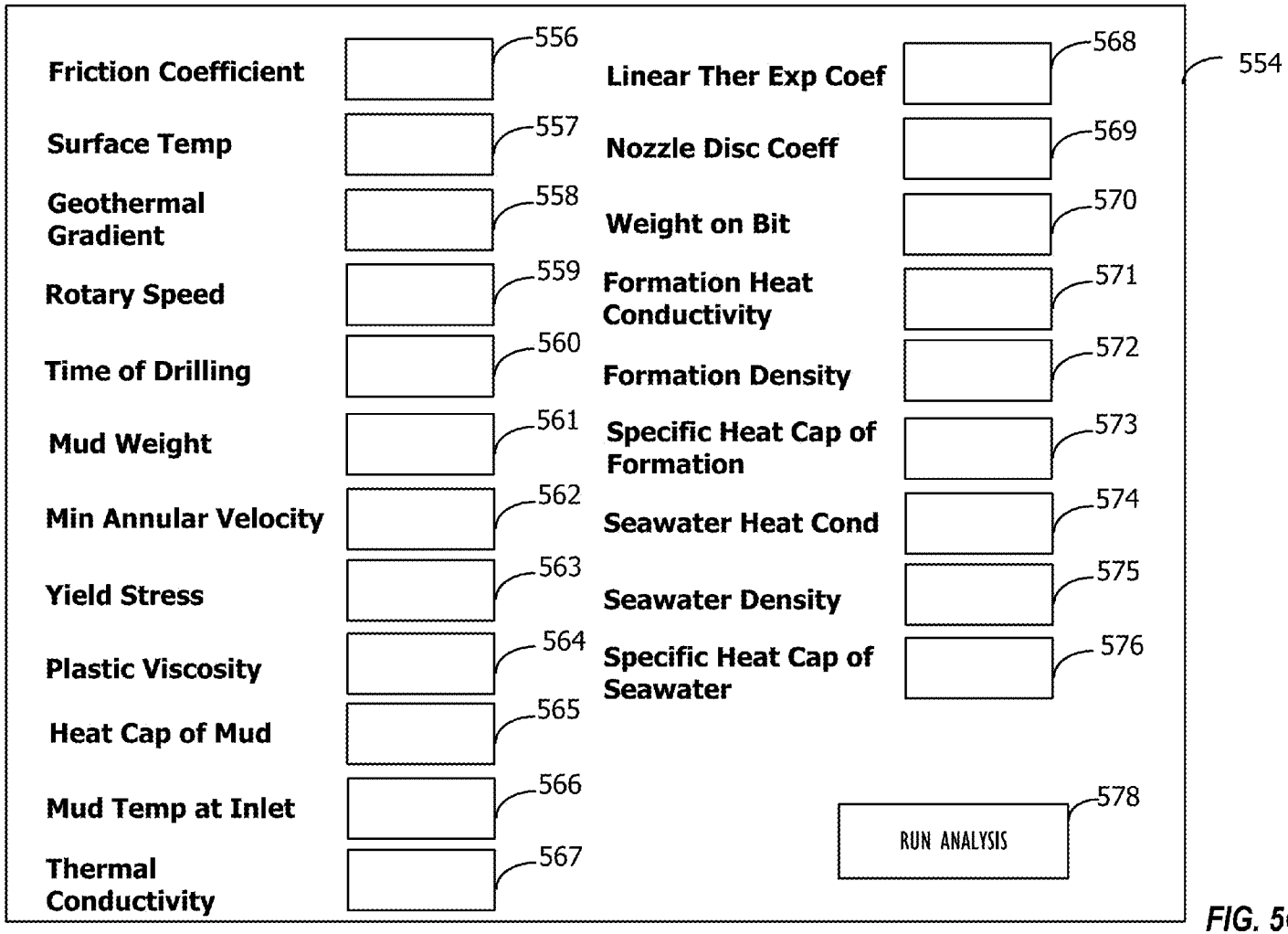
Figure 5D:
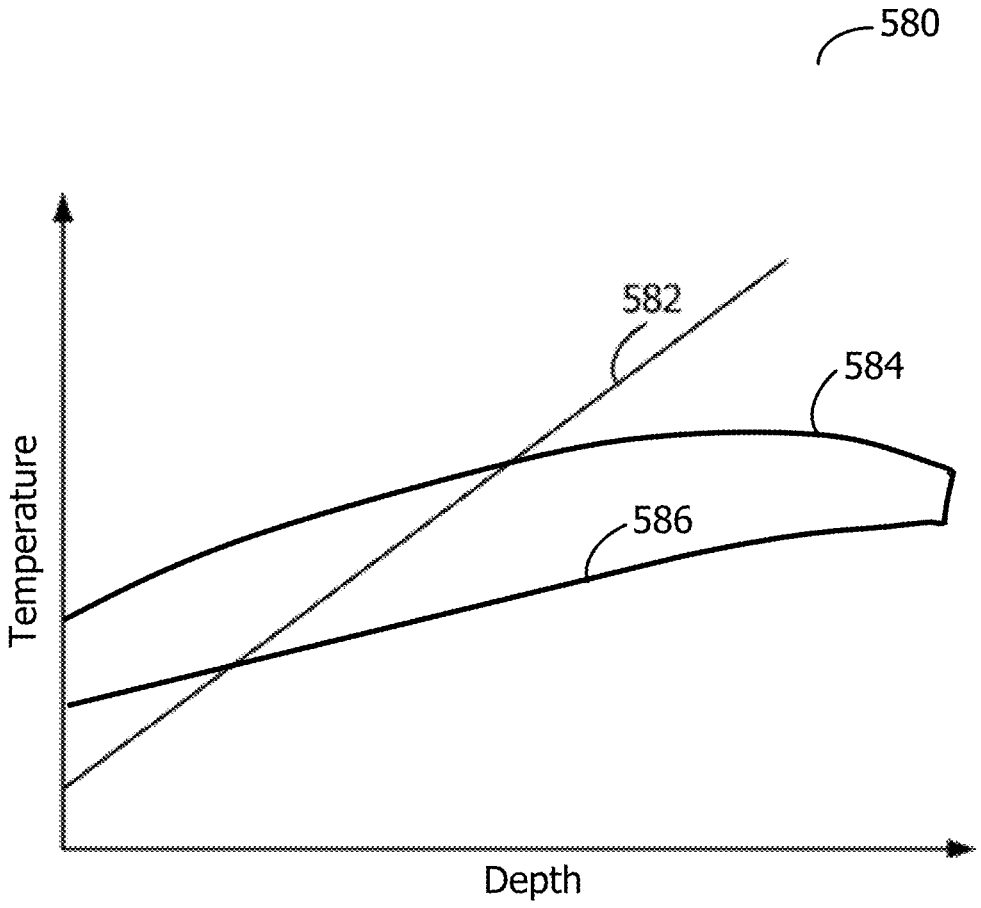

Choosing to predict the mud temperature at this point may take the user to input screen 554 of FIG. 5C, where a plurality of text boxes are again provided for entering values for various parameters relating to drilling, mud, bit and/or formation. These parameters include, in one embodiment, friction coefficient 556, surface temperature 557, geothermal gradient 558, rotary speed 559, time of drilling 560, mud weight 561, minimum annular velocity 562, yield stress 563, plastic viscosity 564, heat capacity of mud 565, mud temperature at drill pipe inlet 566, thermal conductivity of mud 567, linear thermal expansion coefficient of mud 568, nozzle discharge coefficient 569, weight on bit 570, formation heat conductivity 571, formation density 572, specific heat capacity of formation 573, seawater heat conductivity 574, seawater density 575, and specific heat capacity of seawater 576.

Similar to screen 400 of FIG. 4B, screen 554 may provide text boxes or dropdown boxes for inputting data for each of the parameters. Additionally, ranges of data may be provided for one or more of the parameters. Moreover, the list of parameters may also be altered to remove, replace or add additional parameters.

Once all available and/or required parameters have been entered, the user may run the analysis by pressing the run analysis button 578. In one embodiment, this may present the user with an output screen where a graph 580 illustrating downhole temperature profile is shown. Graph 580 is a graph of temperature versus measured depth and illustrates how drill pipe temperature, annulus temperature and geothermal gradient vary as the depth of the well increases. Line 586 illustrates variations of the drill pipe temperature, while line 582 shows variations of the temperature of the formation. Line 584 illustrates how temperature in the annulus changes as depth increases which temperature corresponds to temperature of the mud. Graph 580 can thus provide a complete picture of mud temperature in the wellbore.

Figure 6A:
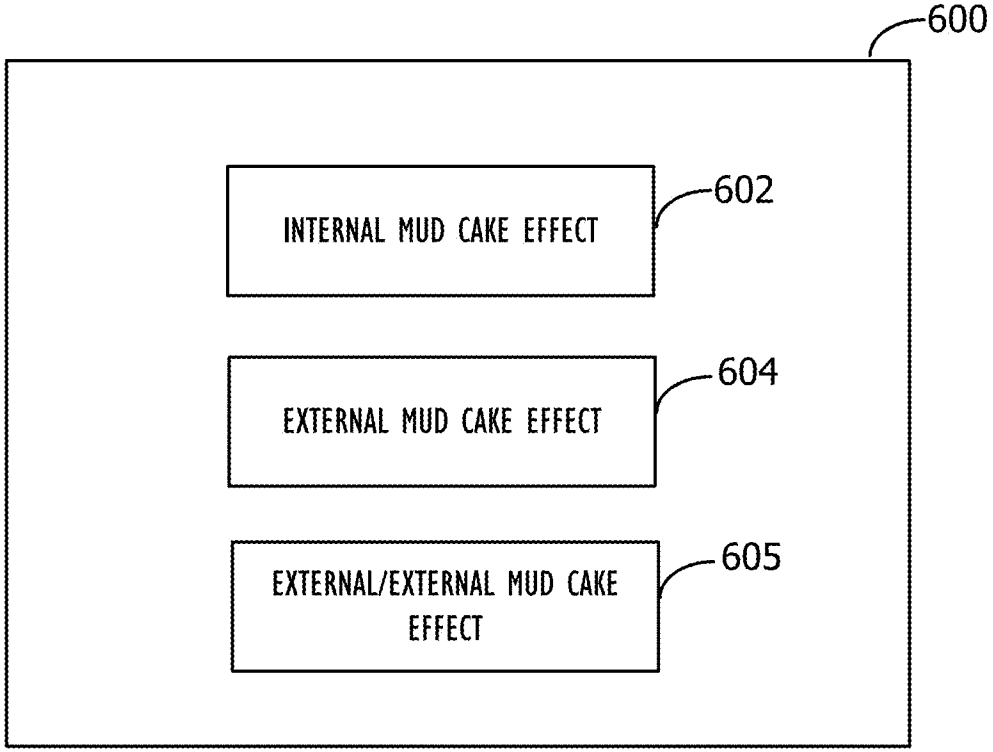
FIGS. 6A-6E are illustrative user interfaces for running an advanced wellbore stress and stability analysis which takes into account mud cake effects, according to one or more disclosed embodiments.

Referring back to FIG. 5A, if mud cake effects 504 is selected on screen 500, the user may be taken to screen 600 of FIG. 6A to choose the type of mud cake effect to take into the account in the analysis. There are at least two types of mud cake effects that can be considered in analyzing stress of the wellbore. Internal mud cake refers to the mud cake present inside the formation due to particle invasion, while external mud cake refers to the mud cake that might form above the wellbore wall. To account for external mud cake effects, time-dependent mud cake properties such as thickness and permeability could be taken into account. On the other hand, to account for internal mud cake effects, time-independent values for internal mud cake permeability and thickness can be taken into account.

Figure 6B:
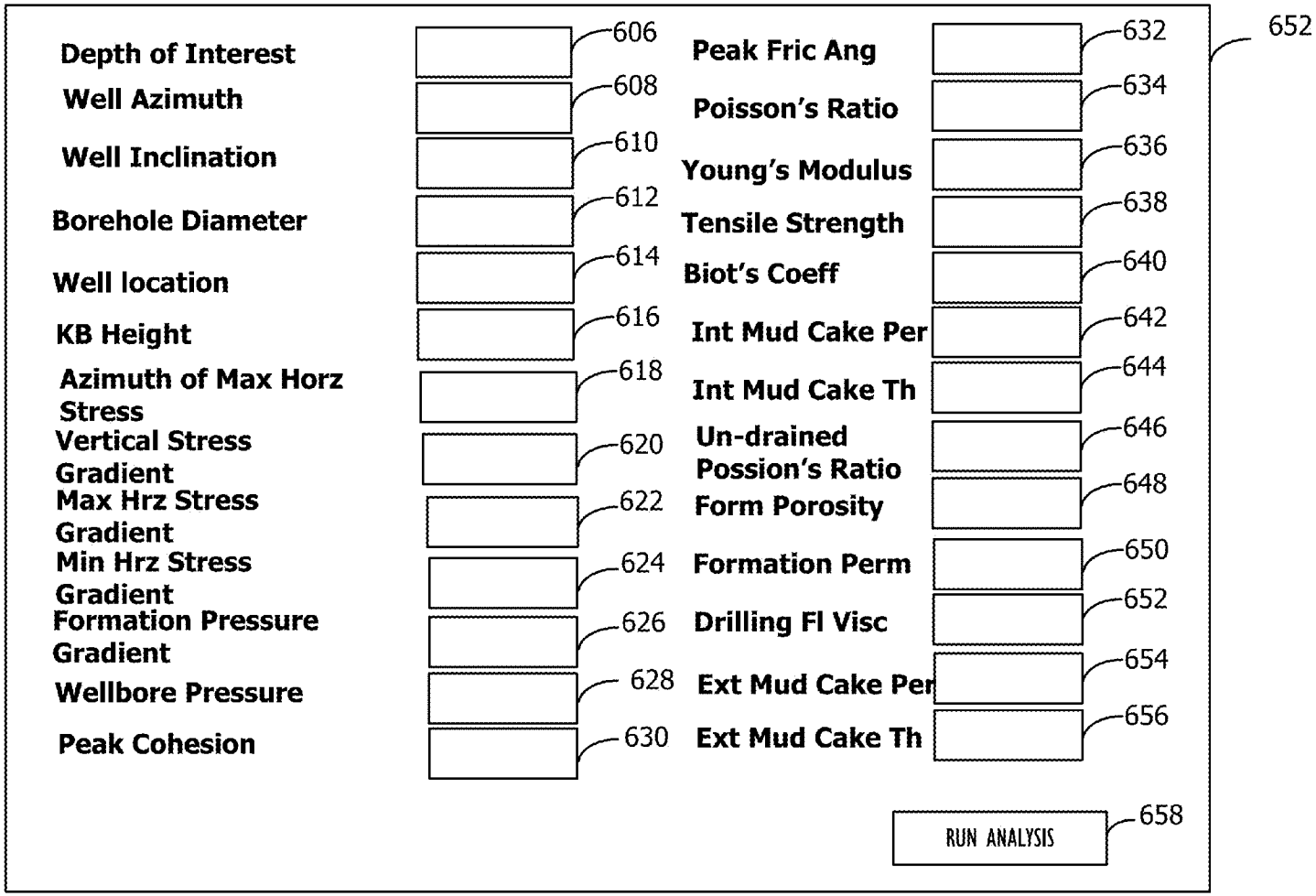

When both internal and external mud cake effects should be taken into account in an analysis, the internal/external mud cake effect button 605 may be selected, upon which input screen 652 of FIG. 6B may be presented to the user. The parameter list for performing an advanced stress analysis which takes into account internal and external mud cake effects includes, in one embodiment, depth of interest 606, well azimuth 608, well inclination 610, borehole diameter 612, well location 614, Kelly Bushing height (relative to ground level) 616, azimuth of maximum horizontal stress 618, vertical stress gradient 620, maximum horizontal stress gradient 622, minimum horizontal stress gradient 624, formation pressure gradient 626, wellbore pressure 628, peak cohesion 630, peak friction angle 632, Poisson's ratio 634, Young's modulus 636, tensile strength 638, Biot's coefficient 640, internal mud cake permeability 642, internal mud cake thickness 644, un-drained Poisson's ratio 646, formation porosity 648, formation permeability 650, drilling fluid viscosity 652, external mud cake permeability 654, and external mud cake thickness 656. It should be noted that values for mud cake permeability, and mud cake thickness should be time dependent. As can be noted, some of these parameters overlap with parameters presented on previously discussed input screens.

Pressing the run analysis button 658 generally results in the tool running a complete stress analysis of the wellbore which takes into account, among other things, external and internal mud cake effects. The results may be presented to the user in the form of an output screen similar to screen 464 of FIG. 4C, where a safe mud weight window of the wellbore for each depth can be determined.

Figure 6C:
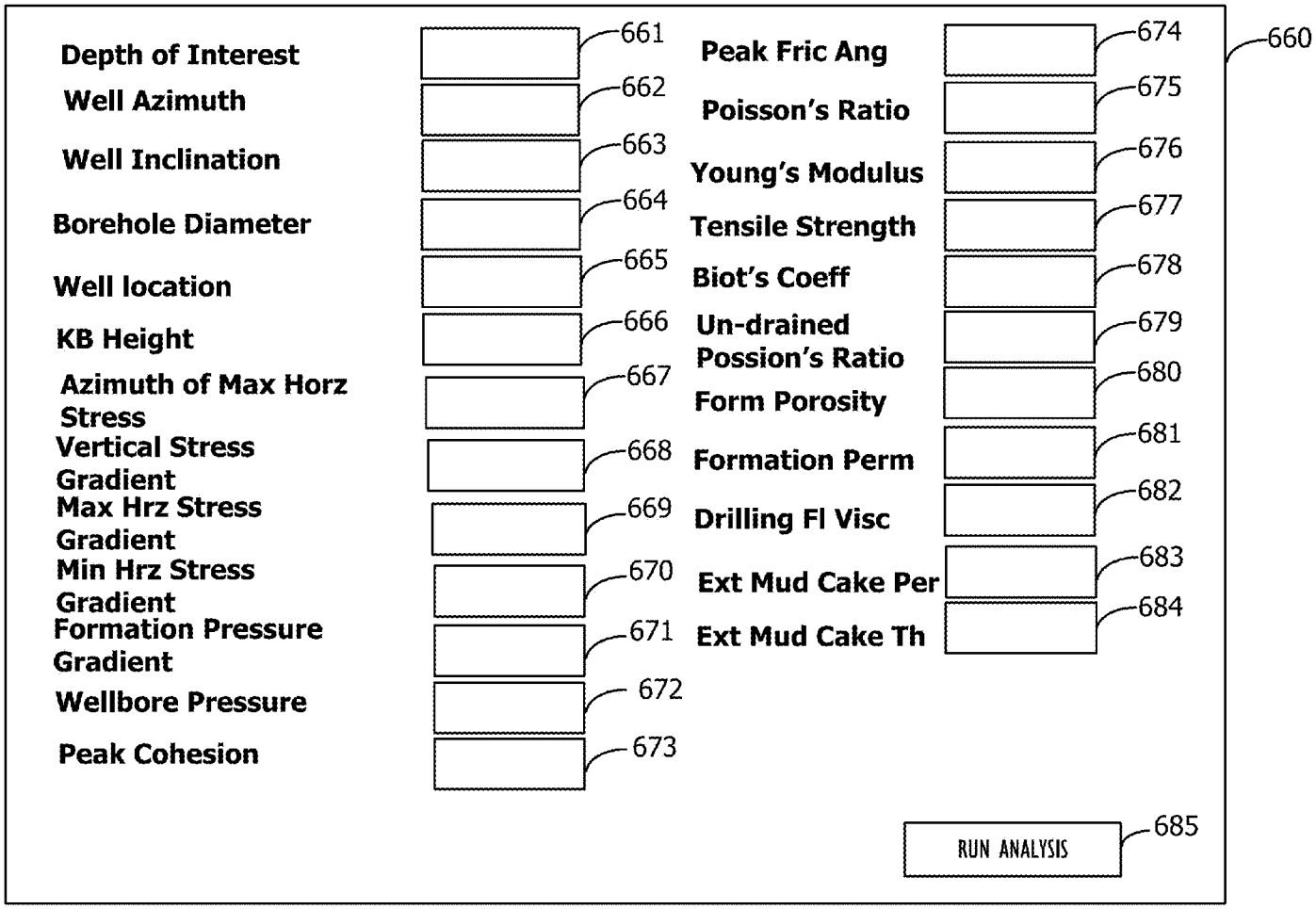

Referring back to FIG. 6A, when the external mud cake effect button 604 is selected to only take into account external mud cake effects, the user may be presented with input screen 660 shown in FIG. 6C where values for multiple parameters can be entered. These parameters include, in one embodiment, depth of interest 661, well azimuth 662, well inclination 663, borehole diameter 664, well location 665, Kelly Bushing height (relative to ground level) 666, azimuth of maximum horizontal stress 667, vertical stress gradient 668, maximum horizontal stress gradient 669, minimum horizontal stress gradient 670, formation pressure gradient 671, wellbore pressure 672, peak cohesion 673, peak friction angle 674, Poisson's ratio 675, Young's modulus 676, tensile strength 677, Biot's coefficient 678, un-drained Poisson's ratio 679, formation porosity 680, formation permeability 681, drilling fluid viscosity 682, external mud cake permeability 683, and external mud cake thickness 684. It should be noted that values for external mud cake permeability 683, the calculation in this case being time dependent.

Figure 6D:
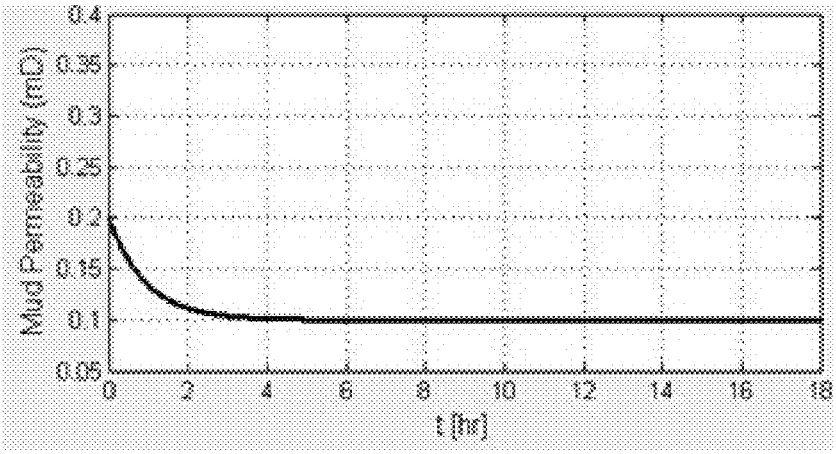
Figure 6E:
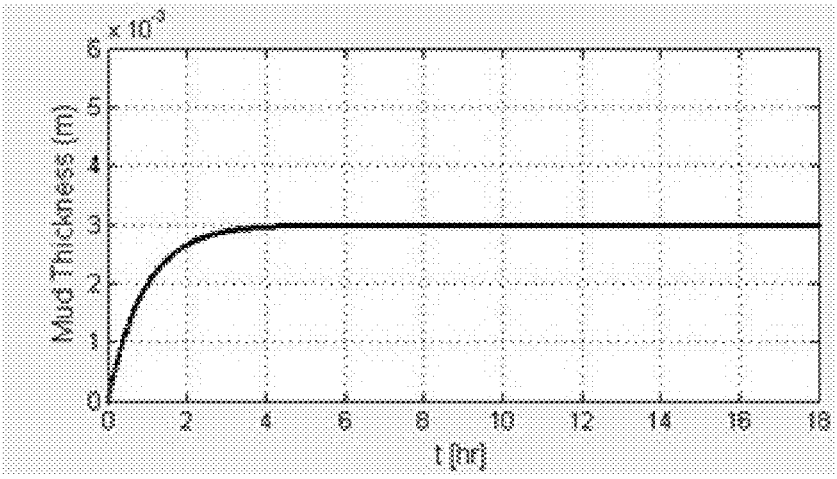

Because mud cake thickness and permeability change over time, values for mud cake thickness and mud cake permeability may be input, in one embodiment, in the form of graphs, examples of which are illustrated in FIGS. 6D and 6E. As shown in graph 686 of FIG. 6D, mud cake permeability changes with time, which in this case is a decrease in value. Graph 688 of FIG. 6E shows how mud cake thickness increases rapidly in the first three hours and then stabilizes. Other methods may also be used for entering values for these time dependent parameters.

Referring back to FIG. 6C, once data for all required and/or available parameters is entered, analysis can be performed by selecting the run analysis button 685 which may result in the tool running a complete stress analysis of the wellbore which takes into account, among other things, mud cake permeability and thickness. The results may be presented to the user in the form of an output screen similar to screen 464 of FIG. 4C, where the safe mud weight window of the wellbore for each depth is illustrated and is a time-dependent calculation.

Referring back to FIG. 6A, when the internal mud cake effect button 602 is selected to only take into account internal mud cake effects, the user may be presented with an input screen similar to input screen 652 shown in FIG. 6B. However the input screen for taking into account internal mud cake effects will generally contain text boxes for parameters 606-652, but would not include text boxes for parameters 654 and 656 which relate to external mud cake properties. After input parameters have been entered into the input screen, an analysis for taking into internal mud loss properties may be performed and the results may be shown in an output screen similar to output screen 464 of FIG. 4C, where the safe mud weight window of the wellbore for each depth is illustrated.

In addition to performing a stress analysis, the integrated solution disclosed herein can also perform an integrated wellbore strengthening analysis based on different mechanisms and the complete stress tensor obtained from stress analysis. For example, various strengthening techniques may be analyzed to determine how they would affect the fracture gradient or the safe mud weight window. Additionally, various techniques may be analyzed to predict possible loss of mud weight as a result of each technique.

Figure 7A:
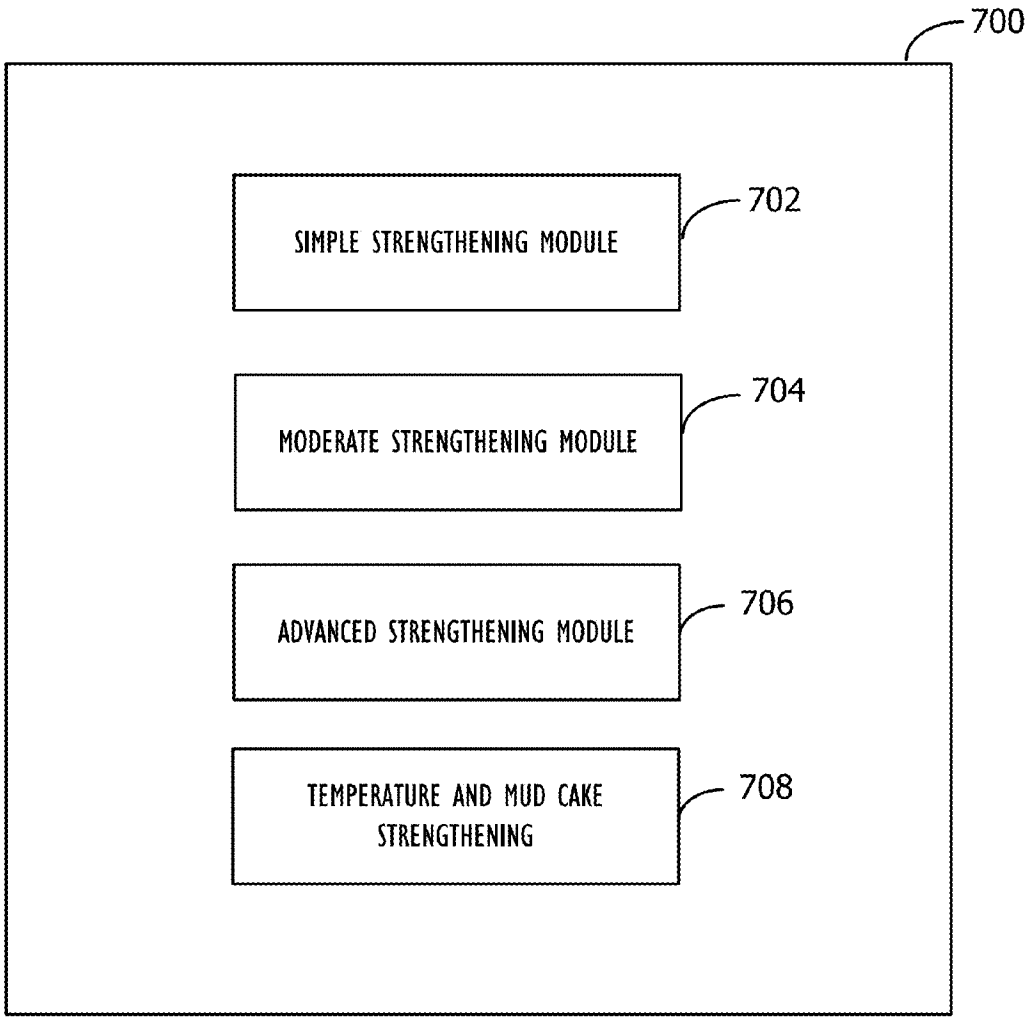
FIGS. 7A-7I are illustrative user interfaces for running a wellbore strengthening analysis, according to one or more disclosed embodiments.

Referring back to FIG. 3, to perform a wellbore strengthening analysis the user may, in one embodiment, select the fracture strengthening analysis button 304 upon which the user may be taken to screen 700 of FIG. 7A. Alternatively, buttons may be provided on the output screens of each of the stress analyses to take the user directly to screen 700. Screen 700 provides four different strengthening options to select from. Alternative embodiments may provide fewer or more options.

The strengthening techniques provided on screen 700 include a simple module, a moderate module, an advance module for a fracture plugging strengthening technique and a temperature strengthening technique. The simple module technique has some limitations with respect to linear elastic calculations, isotropic stress conditions, constant fracture length, or when used in vertical wells. Additionally, the simple module technique does not take into near wellbore stress effects. The moderate module has some advantages over the simple module, which include working well in anisotropic conditions and taking into account near wellbore stress effects. However, the moderate module generally operates best for vertical wells. Additionally, the moderate module does not provide a fracture width distribution. The advanced module has many advantages over the simple and the moderate modules. These advantages include providing a transient thermo poro-elastic solution, including near wellbore stress effects, working well for deviated wells, anisotropic stress conditions, and providing an integrated solution for fracture width distribution and length prediction and corresponding fracture re-initiation pressure after plugging.

Figure 7B:
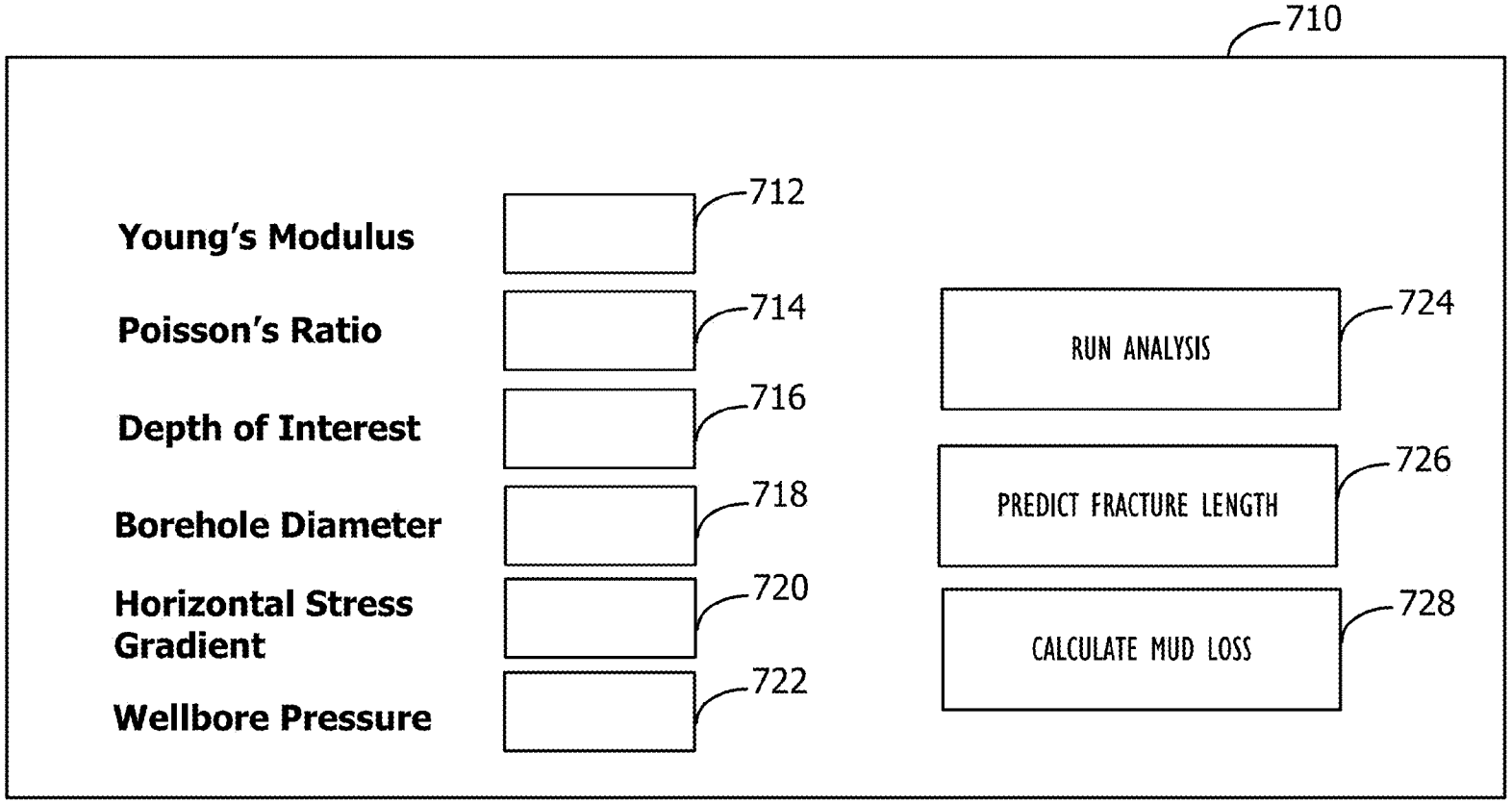
Figure 7C:
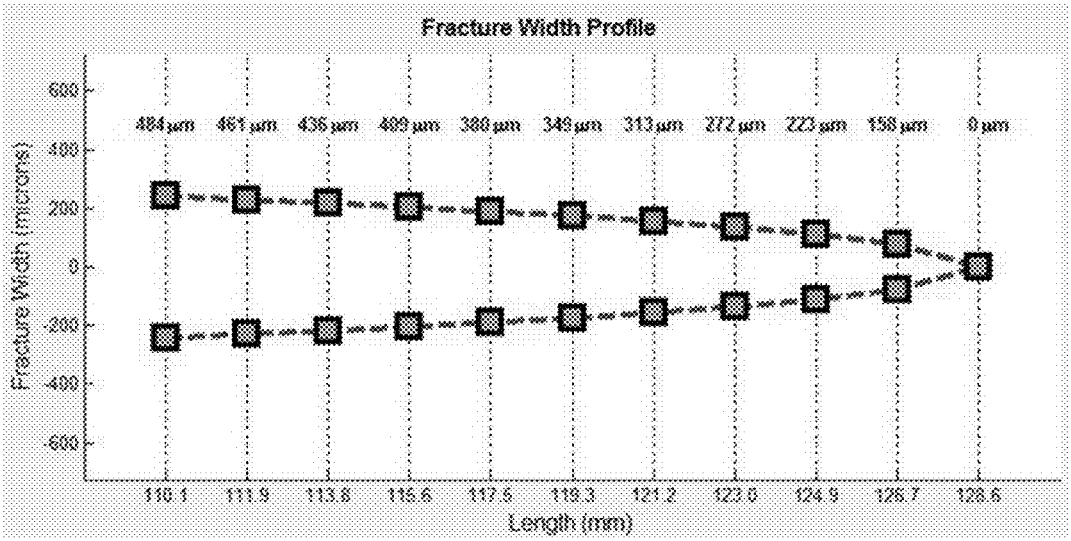

Selecting to perform a simple module strengthening analysis by pressing the simple module button 702 may take the user to input screen 710 of FIG. 7B, where the user is prompted to enter values for multiple parameters. These parameters include, in one embodiment, Young Modulus 712, Poisson's ratio 714, depth of interest 716, borehole diameter 718, stress gradient 720, and wellbore pressure 722. Once all available and/or required parameters have been entered, the user may select to run the analysis by pressing the run analysis button 724, upon which the user may be taken to output screen 730 of FIG. 7C.

The output screen 730 may provide a graph showing the fracture width profile for a constant length fracture induced under wellbore pressure. As shown, the screen 730 may illustrate the predicted width versus the input value of length of an induced fracture. Using integrated analysis, fracture length can be calculated using the stress analysis and imported to the strengthening analysis. The information provided on screen 730 may help the user select a proper LCM particle size distribution for plugging the induced fracture and strengthening the wellbore.

Figure 8A:
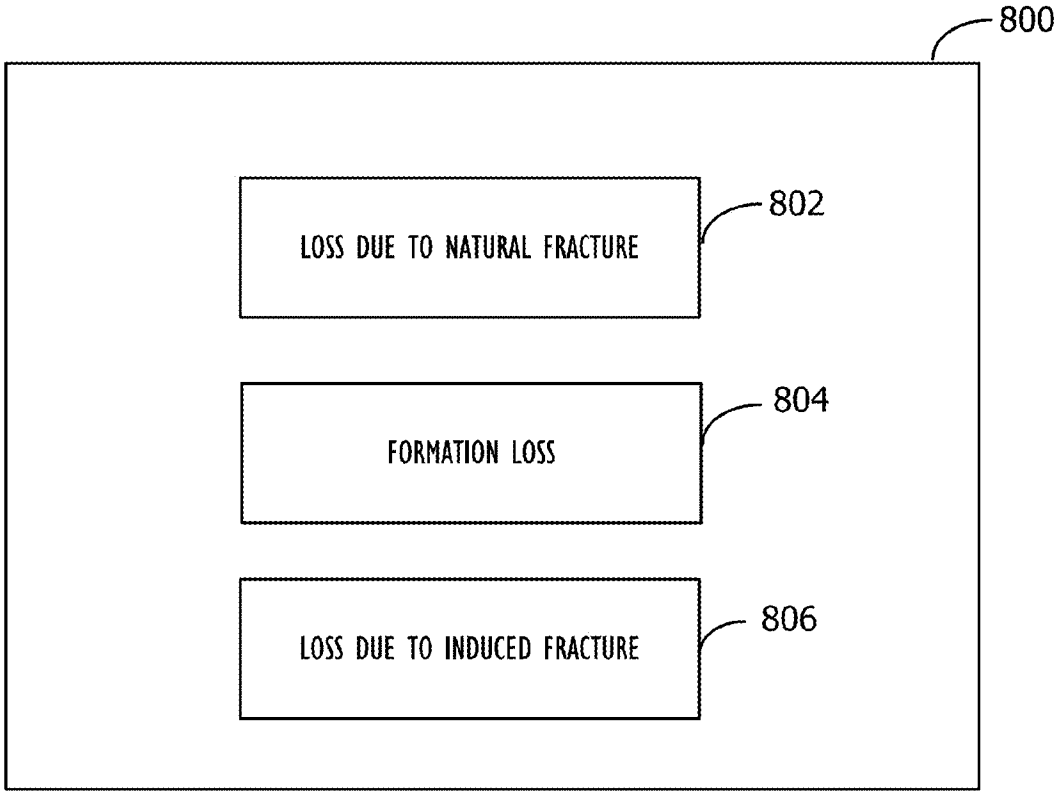
FIGS. 8A-8D are illustrative user interfaces for running a mud loss analysis, according to one or more disclosed embodiments.

Referring back to FIG. 7B, in addition to running the strengthening analysis, the user can also decide to predict a fracture size by pressing the predict fracture size 726. Additionally, after the strengthening analysis has been performed, the user may decide to calculate mud loss from the induced fracture by pressing the calculate mud loss button 728. Alternatively, mud loss may be calculated by selecting the mud analysis button 306 of FIG. 3. Selecting to predict the fracture size may prompt the user enter a value for the ECD, based on which an estimated fracture length may be calculated and presented to the user. The fracture length may be calculated utilizing the complete stress tensor obtained from the stress analysis and the calculated length may be used as an input for the strengthening analysis. Selecting to calculate mud loss may take the user to screen 800 of FIG. 8A to calculate potential mud loss due to a facture. Screen 800 is discussed in detail below.

Figure 7D:
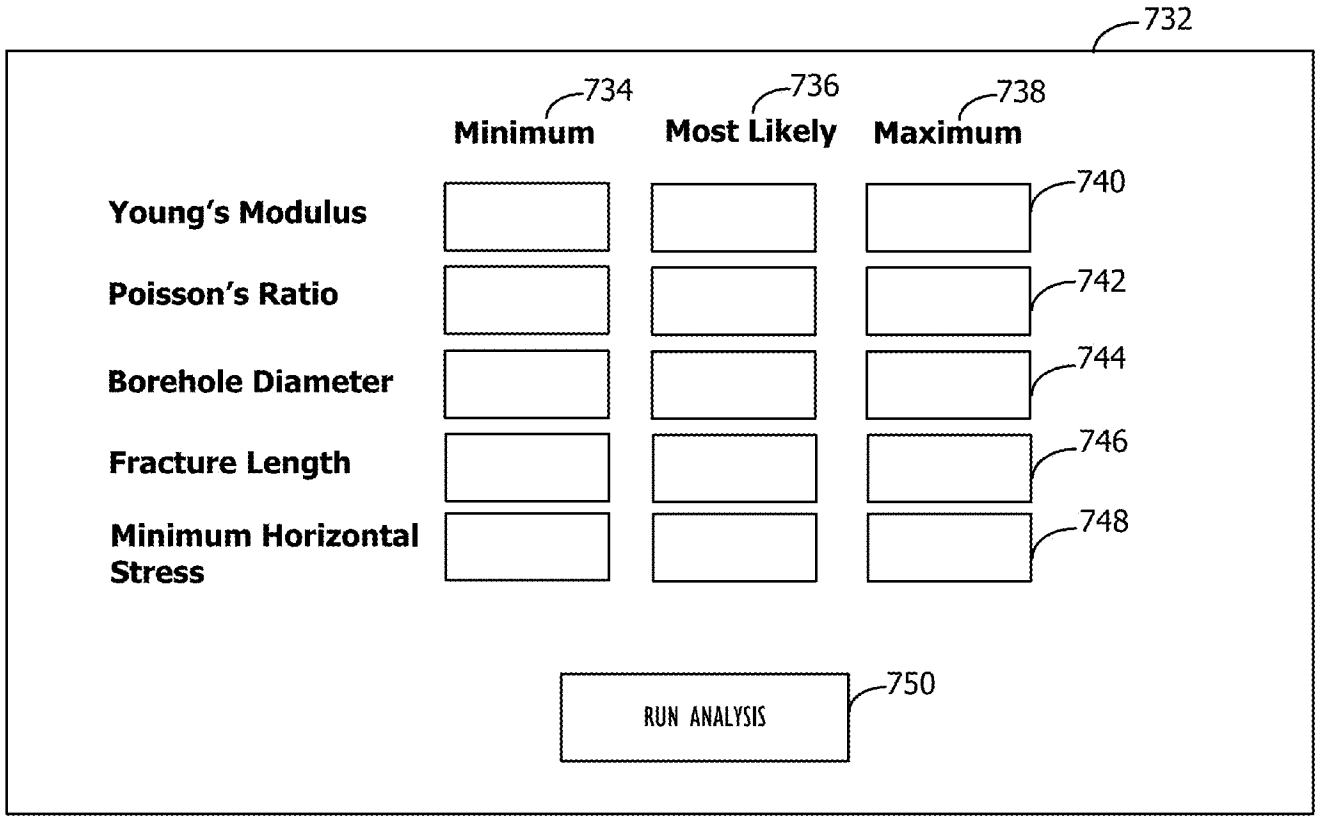

In situations in which uncertainties exists in values of certain input parameters, an input screen such as input screen 732 of FIG. 7D may be presented to the user. Screen 732 provides a column of text boxes 734 for inputting an estimated minimum value for each of the input parameters, a column of text boxes 736 for inputting most likely values for each of the input parameters and a column 738 for inputting maximum values for each of the input parameters. Thus for each of the input parameters, Young's modulus 740, Poisson's ratio 742, borehole diameter 744, fracture length 746, and minimum horizontal stress 748, three input values may be provided. In another embodiment, the ranges that can be input may be different than minimum, most likely and maximum. In yet another embodiment, only two options for inputting values may be presented. An alternative embodiment to screen 732 may provide an option for inputting a fixed value for each parameter if available or alternatively provide a range of values as demonstrated on screen 732, when there are uncertainties in the value of a certain parameter.

Figure 7E:
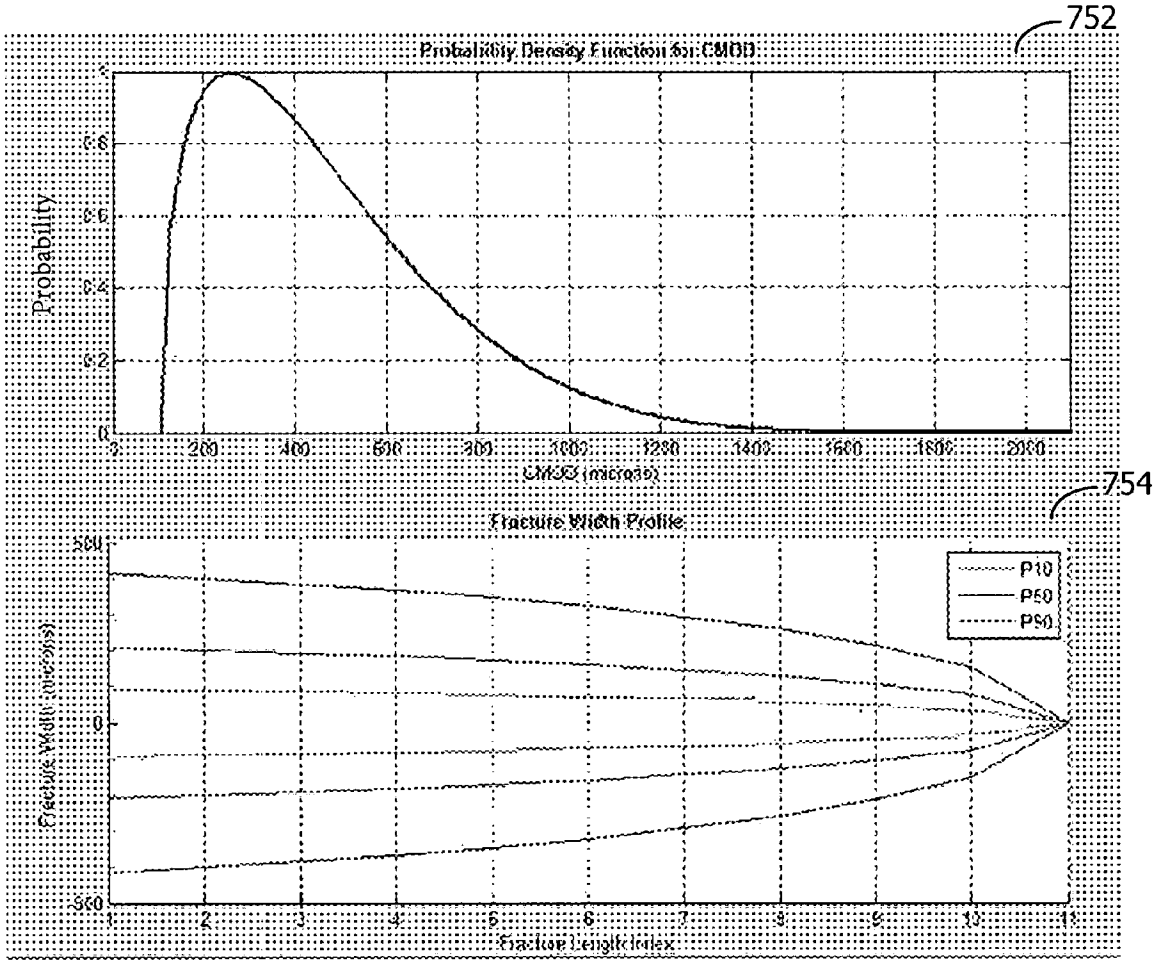

When a range of values is input for one or more of the input parameters, the tool may run a statistical analysis, such as the Monte-Carlo algorithm to determine the output results. When the run analysis button 750 is pressed on screen 732 to initiate a simple strengthening analysis, the tool runs such a statistical analysis. The output of the analysis may be presented in the form of graphs, examples of which are provided in FIG. 7E. Graph 752 illustrates the probability density function for crack mouth opening displacement (CMOD). This is a probability distribution of fracture opening at the mouth of a fracture. Graph 754 illustrates various statistical parameters (i.e., P90, P50 and P10) of the width distribution for a given fracture length. These statistical parameters present a range of output values corresponding to the range of input values, where the range of output values is presented as a probability distribution.

Figure 7F:
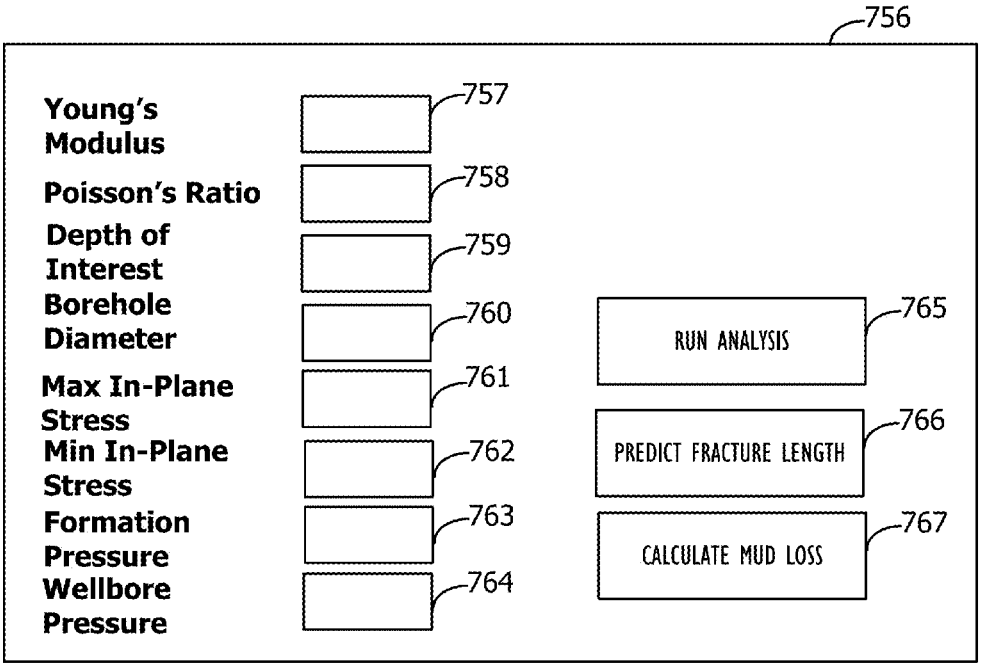
Figure 7G:
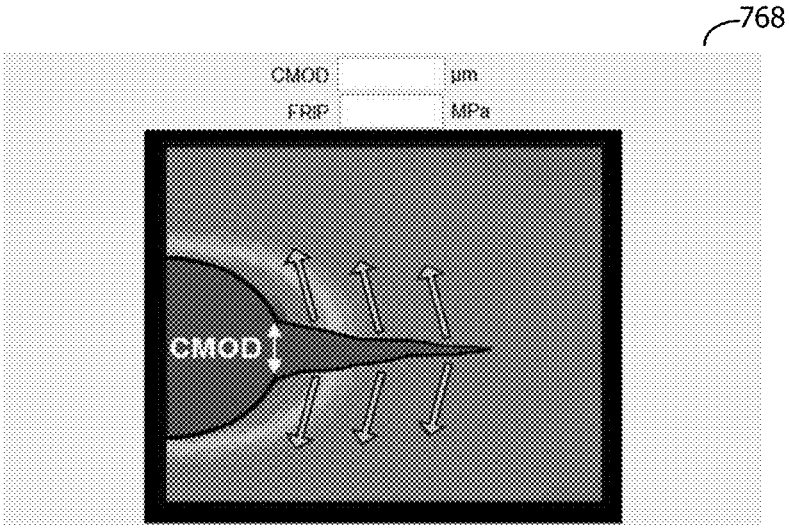

Referring back to FIG. 7A, if the user selects to perform a moderate module strengthening analysis by pressing the moderate strengthening module button 704, the user may be taken to input screen 756 of FIG. 7F to enter values for multiple parameters. These parameters include, in one embodiment, Young's Modulus 757, Poisson's ratio 758, depth of interest 759, borehole diameter 760, maximum in-situ stress 761, minimum in-situ stress 762, formation pressure 763, and wellbore pressure 764. Choosing to perform a moderate module strengthening analysis may be done by selecting the run analysis button 765. Graphs similar to the graph shown in output screen 768 of FIG. 7G may be presented to the user after the analysis is run to illustrate crack mouth opening displacement (CMOD) of a fracture before a plugging operation.

The user may also choose to predict the fracture length on screen 756 (FIG. 7F) by selecting the predict fracture length button 765. This may prompt the user to enter a value for the ECD, based on which an estimated fracture length may be calculated and used for CMOD calculation. Additionally, after the strengthening analysis has been performed, the user may decide to calculate mud loss from the induce fracture by pressing the calculate mud loss button 767. Alternatively, mud loss may be calculated by selecting the mud analysis button 306 of FIG. 3.

Figure 7H:
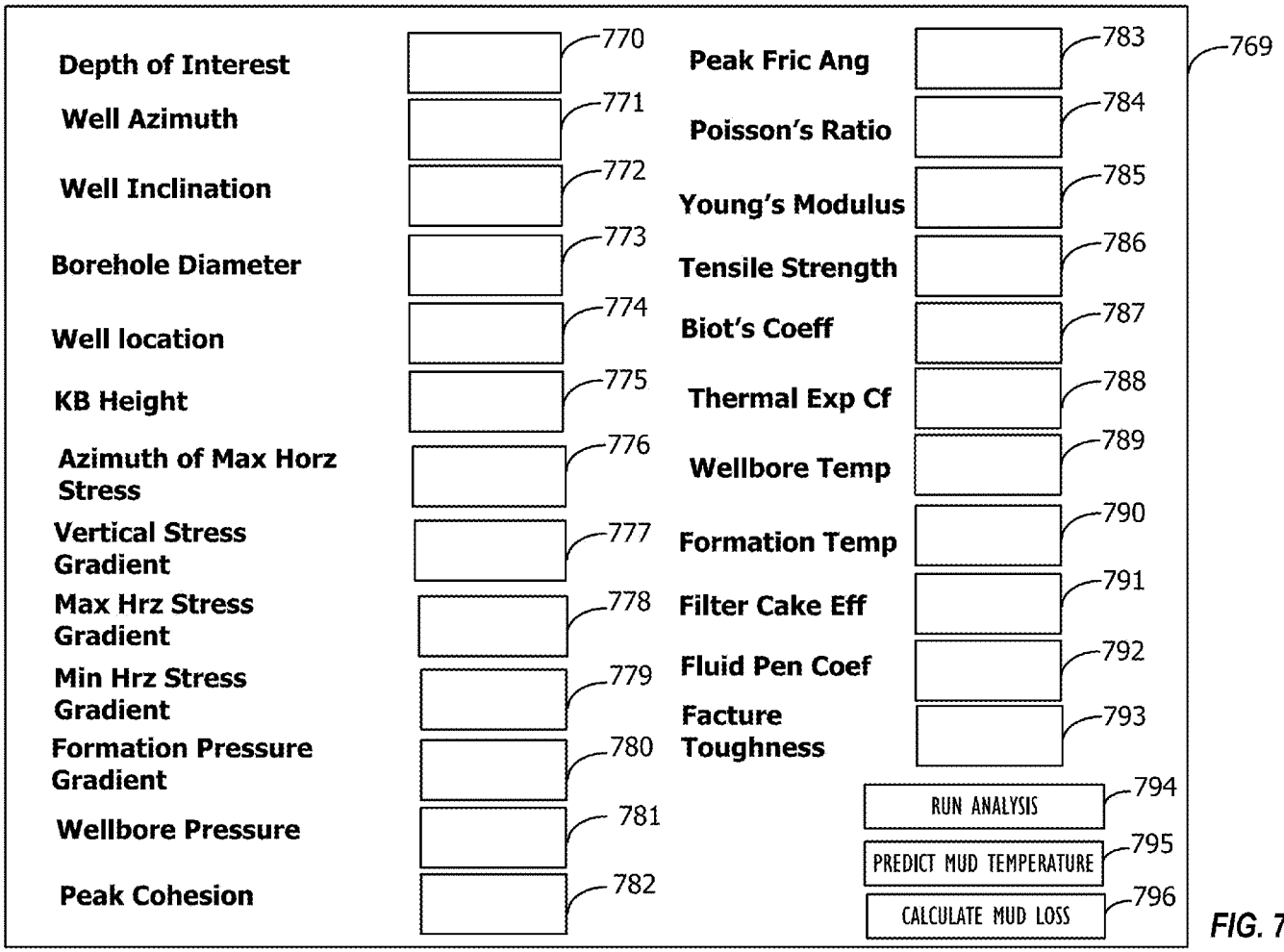

Referring back to FIG. 7A, if the user selects to perform an advanced module strengthening analysis by pressing the advanced module button 706, the user may be taken to input screen 769 of FIG. 7H to enter values for multiple parameters. These parameters include, in one embodiment, depth of interest 770, well azimuth 771, well inclination 772, borehole diameter 773, well location 774, Kelly Bushing height (relative to ground level) 775, azimuth of maximum horizontal stress 776, vertical stress gradient 777, maximum horizontal stress gradient 778, minimum horizontal stress gradient 779, formation pressure gradient 780, wellbore pressure 781, peak cohesion 782, peak friction angle 783, Poisson's ratio 784, Young's modulus 785, tensile strength 786, Biot's coefficient 787, thermal expansion coefficient 788, wellbore temperature 789, formation temperature 790, filter cake efficiency 791, fluid penetration coefficient 792, and fracture toughness 793. These parameters are used when the advanced strengthening analysis is performed based on the simple stress analysis. Alternatively, the advanced strengthening analysis may be performed based on the advanced stress analysis in which case all parameters required for advanced stress analysis may be included on the input screen 769.

Figure 7I:
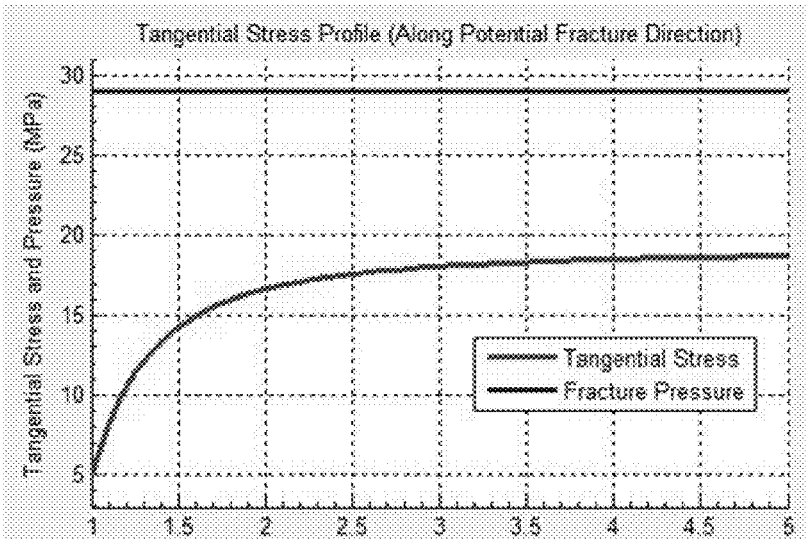
Figure 7I:
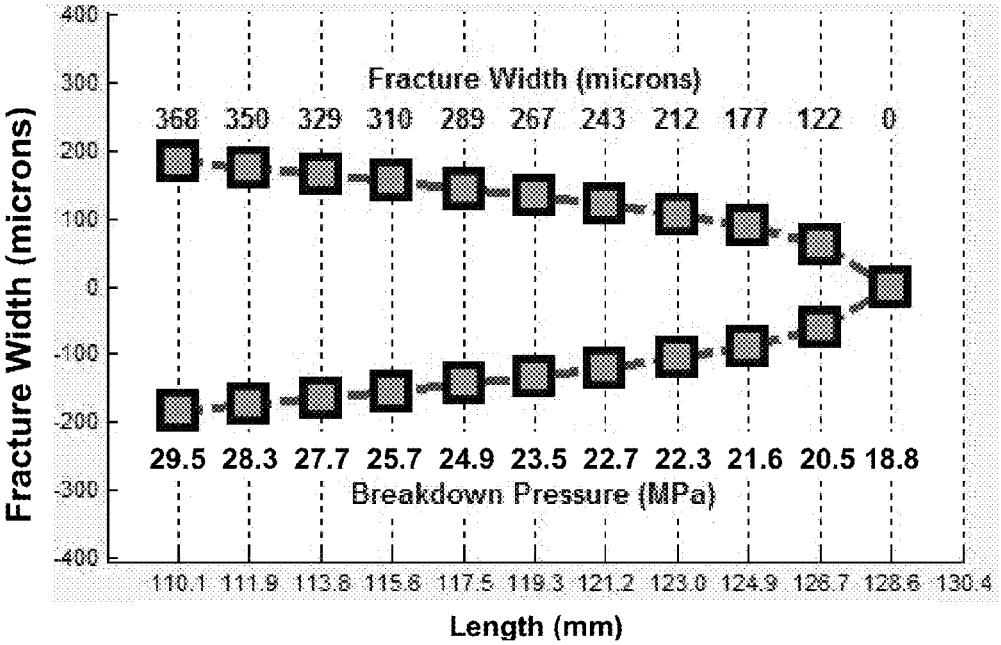

Once all available inputs and desired optional inputs have been entered, the user may choose to perform an advanced module strengthening analysis by pressing the run analysis button 794. In one embodiment, pressing the run analysis button 794 may result in one or more output screens being presented to the user. One such output screen may contain, in one embodiment, the new breakdown pressure of the wellbore for different plug locations. Alternatively, for an embodiment that provides a range of input values, the output screen may contain a graph demonstrating the results of a Monte-Carlo analysis on selected input parameters to report fracture width probability distribution at different locations along the fracture. The effect of plug location on the strengthening can be quantified as an output screen as well. Additionally, output screen such as the screens 796, 797 and 798 of FIG. 7I may present graphs showing various output results. Screen 797 illustrates the tangential stress profile along the potential fracture direction as compared to fracture pressure. The curved output line on the graph (the lower line) shows tangential stress while the straight line shows fracture pressure for this example analysis. Screen 798 shows the fracture width profile along with the breakdown pressure calculated for different plug locations.

The user may also choose to predict the fracture length on screen 769 (FIG. 7H) by selecting the predict fracture length button 795. This may prompt the user to enter a value for the ECD, based on which an estimated fracture length may be calculated and used for CMOD calculation. Additionally, after the strengthening analysis has been performed, the user may decide to calculate mud loss from the induce fracture by pressing the calculate mud loss button 796. Alternatively, mud loss may be calculated by selecting the mud analysis button 306 of FIG. 3.

Utilizing the advanced strengthening results, Fracture Re-Initiation Pressure (FRIP) after plugging can be calculated. In other words, the strengthening effect can be quantified using the advanced module. This result might be compared to the field data after applying wellbore strengthening method. In addition, mud weight window can be modified based on new calculated fracture gradient.

Referring back to FIG. 7A, the user may select to perform a temperature/mud cake strengthening analysis to determine how changing operational parameters affecting wellbore temperature and/or mud cake properties may impact the fracture gradient and the safe mud weight window. Temperature/mud cake strengthening analysis may be initiated by pressing the temperature/mud cake strengthening button 708, upon which the user may be taken to an input screen similar to input screen 554 of FIG. 5B or input screen 652 of FIG. 6B or input screen 660 of FIG. 6C. The input screen to which the user is taken may include parameters relating to wellbore temperatures and/or mud cake properties. By inputting different values for those parameters and running an analysis for each of the different input values, the user may be able to determine how changing those parameters might affect fracture pressure. For example, the user may be able to input different values for mud temperature and run the analysis for each of those values to identify a mud temperature at which the safe mud weight window is wide enough to avoid fracture formation. Then, the operational parameters can be optimized to get desired mud temperature for wellbore strengthening applications. A similar approach can be performed for mud cake strengthening in which mud properties can be modified to get desired wellbore strengthening.

Figure 8B:
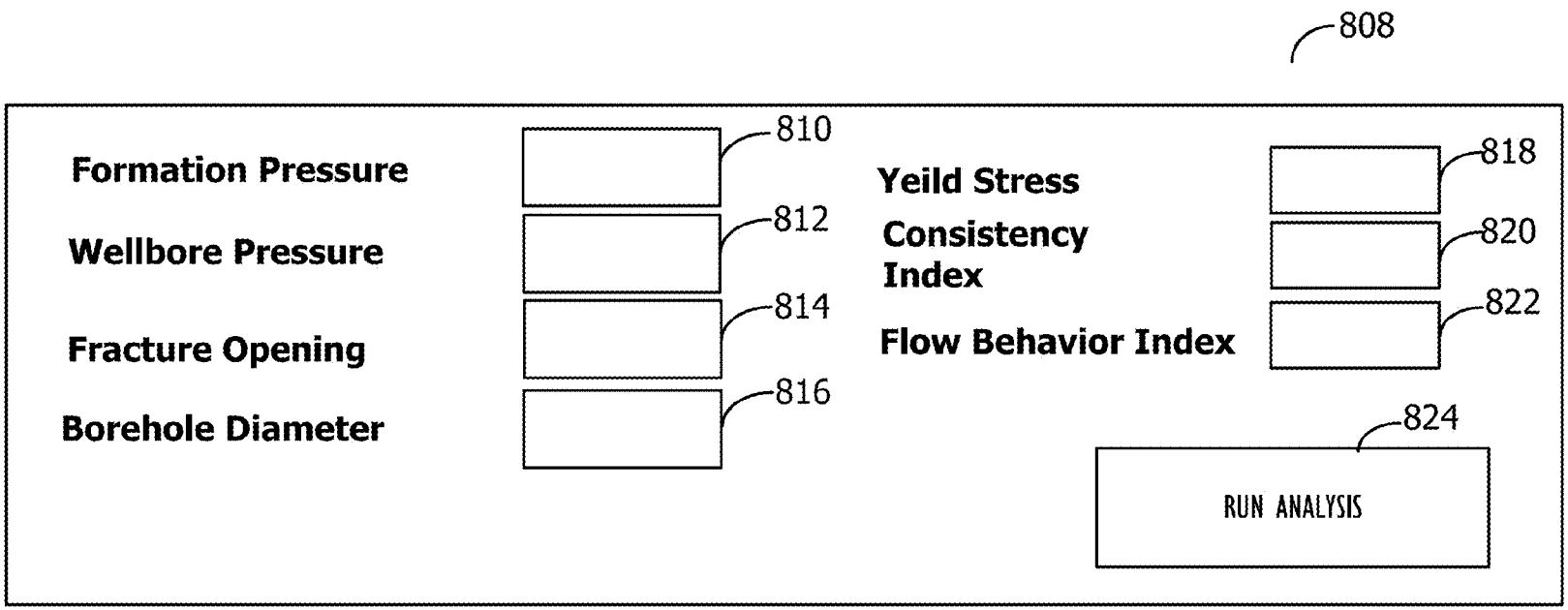

Referring back to FIG. 3, the integrated solution may provide an option for performing a mud loss analysis. Such an analysis may involve, in one embodiment, predicting the amount of mud that may be lost due to an induced fracture, a natural fracture, or into the formation. Mud loss analysis may be initiated in FIG. 3 by pressing the mud loss analysis button upon which the user may be taken to input screen 800 of FIG. 8A to choose a type of mud loss analysis to perform. To conduct a mud loss analysis for losses due to natural fracture, the user may select the loss due to natural fracture button 302 which may take the user to input screen 808 of FIG. 8B to enter values for multiple parameters. These parameters include, in one embodiment, formation pressure 810, wellbore pressure 812, fracture opening 814, borehole diameter 816, yield stress 818, consistency index 820, and flow behavior index 822.

Figure 8C:
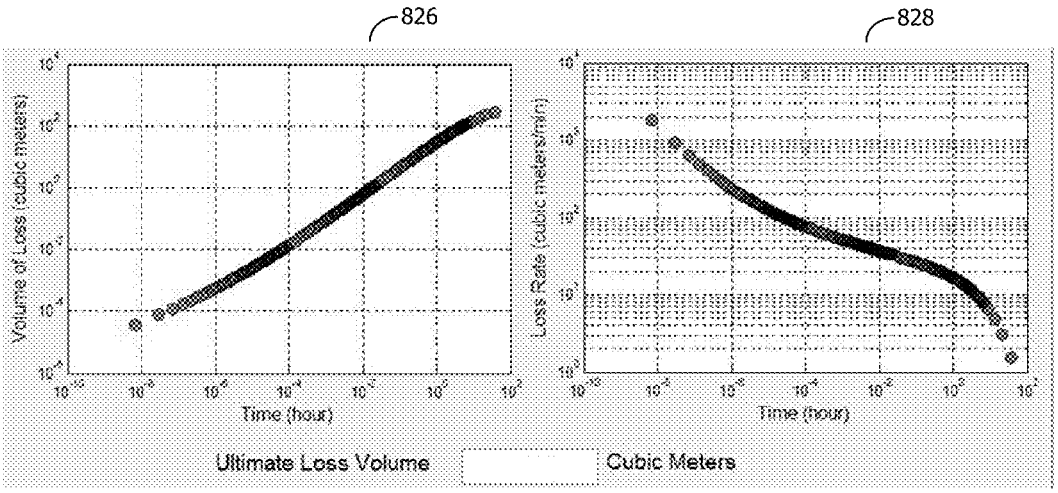

Once all available inputs and optional inputs have been entered, the user may initiate a mud loss analysis by pressing the run analysis button 824. The results of the performed analysis may be shown in one or more output screens. In one embodiment, output screens illustrating graphs such as graph 826 and 828 of FIG. 8C may be shown. Graph 826 shows volume of mud loss over time and graph 828 shows mud loss rate over time.

Figure 8D:
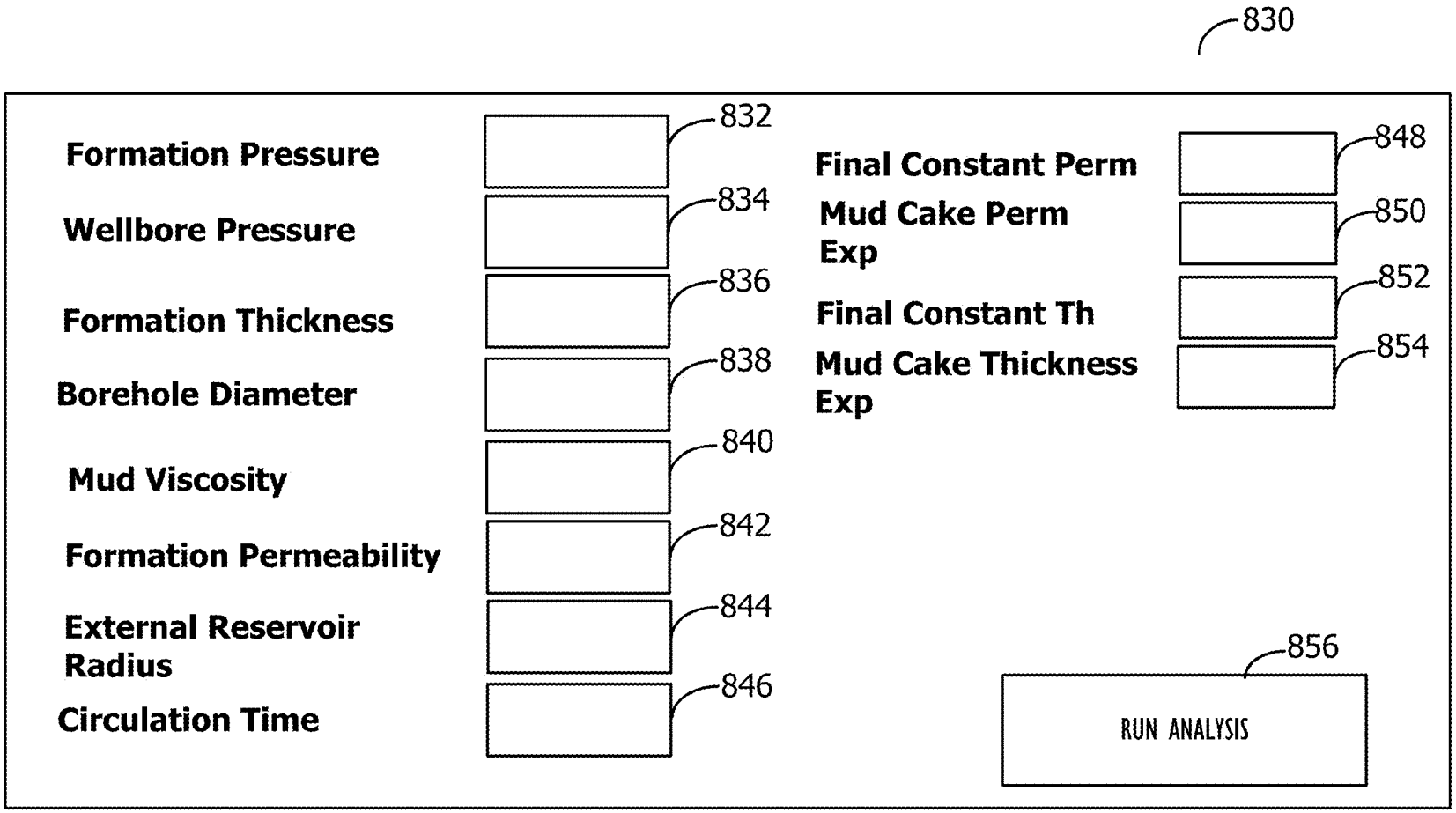

Referring back to FIG. 8A, if the user decided to perform a mud loss analysis for losses in the formation by pressing button 804, an input screen such as the screen 830 of FIG. 8D may be presented to the user. Input screen 830 includes multiple text boxes for entering values for multiple parameters. These parameters include, in one embodiment, formation pressure 832, wellbore pressure 834, formation thickness 836, borehole diameter 838, mud viscosity 840, formation permeability 842, external reservoir radius 844, circulation time 846, final constant permeability 848, mud cake permeability exponent 850, final constant thickness 852 and mud cake thickness exponent 854.

Once all available inputs and optional inputs have been entered, the user may initiate a mud loss analysis by pressing the run analysis button 856. The results of the performed analysis may be shown in one or more output screens. In one embodiment, output screens illustrating graphs similar to graphs 826 and 828 of FIG. 8B may be shown to illustrate volume of mud loss over time and rate of mud loss over time.

Referring back to FIG. 8A, the user may decide to perform a mud loss analysis for calculating losses due to induced fracture(s). This may be done by pressing the loss due to induced fracture button 806 or by pressing the calculate mud loss button 728 of FIG. 7B, button 767 of FIG. 7F or button 796 of FIG. 7H after each of the simple, moderate or advanced strengthening modules. Upon pressing either of these buttons, mud loss due to an induced fracture may be calculated based on parameters input and/or produced during the stress and/or strengthening analyses. Alternatively, an input screen may be provided to enter parameters required for calculating mud loss due to an induced fracture. Once a button to select calculating mud loss due to an induced fracture has been pressed and/or input parameters have been entered, an output screen illustrating graphs similar to graphs 826 and 828 of FIG. 8B may be shown to illustrate volume of mud loss over time and rate of mud loss over time.

Figure 9:
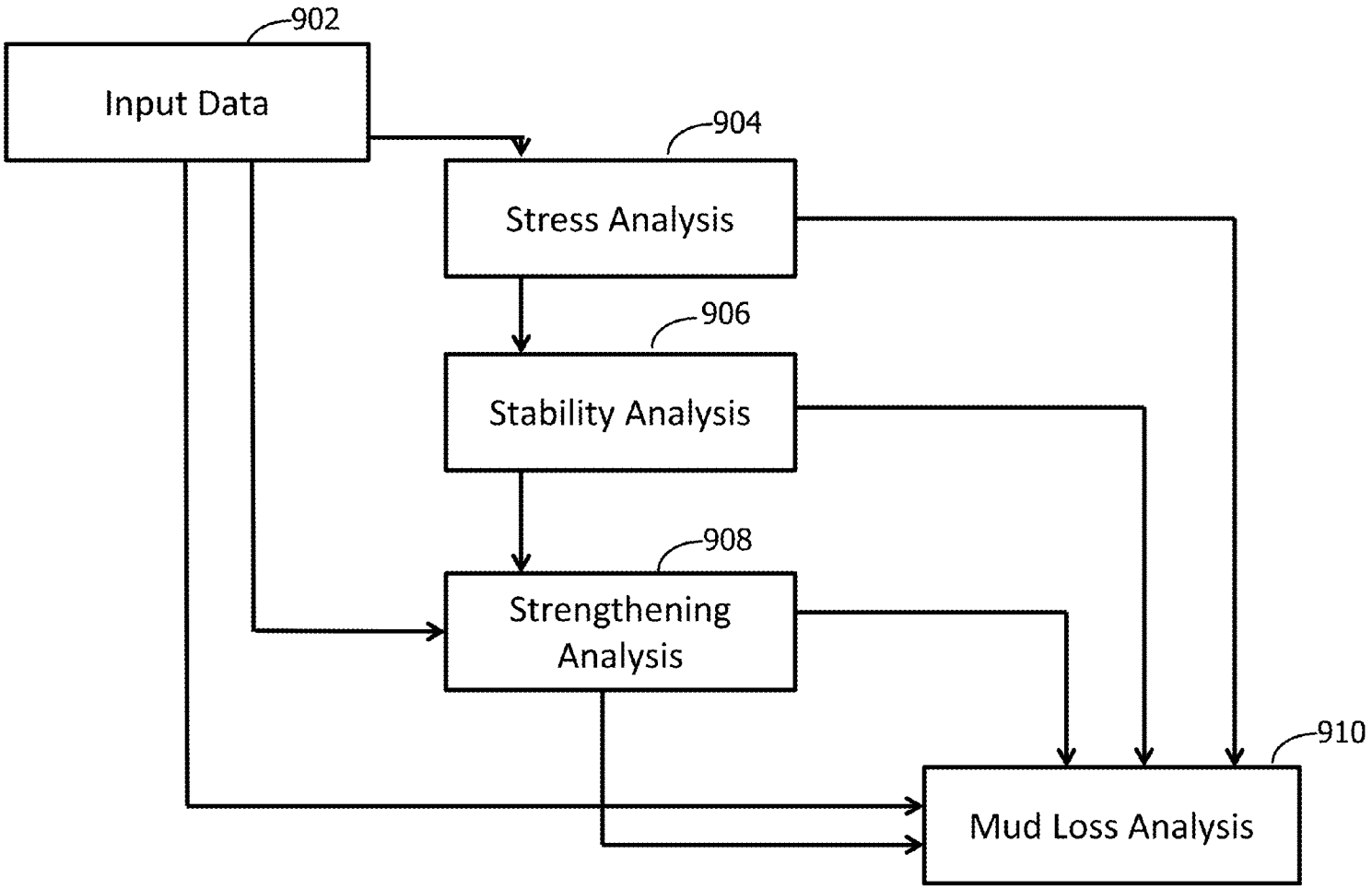
FIG. 9 is a flow chart illustrating the integration of the various analyses, according to one or more disclosed embodiments.

It should be noted that although each of the stress and stability analysis, strengthening analysis and mud loss analysis is described separately in this disclosure, these analyses could be run in an integrated mode. This is illustrated in FIG. 9. In general input data entered for one analysis may be used for other analyses. Thus, input data 902 can be provided to stress analysis 904, strengthening analysis 908 and mud loss analysis 910. Additionally, output results from the stress analysis 904 may be used in performing stability analysis 906, which is conducted as part of the stress analysis 904, in one embodiment. Similarly, output data from the stability analysis 906 is used for performing the strengthening analysis 908. Furthermore, output data from the stress analysis 904, stability analysis 906 and strengthening analysis 908 is used in performing the mud loss analysis 910.

More specifically, the stress analysis 904 and stability analysis 906 may determine a safe mud weight window and help identify troublesome zones. Then, in the identified troublesome zones which require strengthening, the tool may predict a fracture length using the stress tensor obtained from either simple or advanced stress analysis. The fracture length may then be used as an input for the strengthening analysis 908. The tool may perform the strengthening analysis 908 based on fracture plugging. Fracture width distribution in advanced strengthening analysis may be predicted based on the stress analysis calculations. After performing strengthening analysis, mud loss prediction may be performed based on predicted fracture length-width of the stress analysis 904 and strengthening analysis 908. Therefore the integrated workflow may be executed in multiple combinations of stress, stability, strengthening and mud loss modules as shown in FIG. 9.

It should be understood that for all input screens disclosed herein, the input screens may provide one or more text boxes for entering input data for each parameter. The input screens may also provide drop down boxes for one or more of the parameters, where the user can select one option from a range of options provided. The entered data may be a specific number or could be a range of numbers for one or more of the parameters. A range of numbers may be provided, for example, when there are uncertainties in the value of the input parameters. In such a case, a range of values representing a minimum and a maximum value may be input instead of exact values, and a statistical analysis, such as the Monte-Carlo algorithm, may be performed to obtain the outputs.

It should also be noted that input parameters mentioned in each of the input screens of this disclosure are exemplary. In practice, any parameter that provides information about a specific analysis may be used. As such, some of the parameters mentioned may not be used in alternative embodiments, while others may be replaced by new parameters not mentioned here. Additional parameters may also be added to this list in other embodiments.

Each of the analyses disclosed herein may be performed before the start of drilling to predict what may occur during drilling, or may be entered in real time while drilling is being done. The parameters may also be entered and analysis may be performed after drilling is finished.

In one embodiment, the stress, stability and strengthening analyses disclosed herein may provide a near real time application for calibration purposes. This may be done, for example, by performing an analysis to predict the effect of a change in a drilling parameter on the borehole stress and/or stability profile, changing the drilling parameter to measure the actual effect of the change on the borehole stress and/or stability profile, and comparing the results of the prediction to the measured values to determine the accuracy of the prediction. The difference between the predicted borehole stress and/or stability profile and the measured one(s) can then be used to calibrate the tool to increase the accuracy of the analyses.

In the foregoing description, for purposes of explanation, specific details are set forth in order to provide a thorough understanding of the disclosed embodiments. It will be apparent, however, to one skilled in the art that the disclosed embodiments may be practiced without these specific details. In other instances, structure and devices are shown in block diagram form in order to avoid obscuring the disclosed embodiments. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one disclosed embodiment, and multiple references to "one embodiment" or "an embodiment" should not be understood as necessarily all referring to the same embodiment.

It is also to be understood that the above description is intended to be illustrative, and not restrictive. For example, above-described embodiments may be used in combination with each other and illustrative process acts may be performed in an order different than discussed. Many other embodiments will be apparent to those of skill in the art upon reviewing the above description. The scope of the invention therefore should be determined with reference to the appended claims, along with the full scope of equivalents to which such claims are entitled. In the appended claims, terms "including" and "in which" are used as plain-English equivalents of the respective terms "comprising" and "wherein."

What is claimed is:

1. A method implemented with one or more processors and a drilling system, the method comprising:

receiving, at the one or more processors, a plurality of input parameters, each input parameter relating to at least one of a wellbore, a formation in which the wellbore is drilled, and a drilling operation used to drill the wellbore with the drilling system;

generating, with the one or more processors, a geomechanical model of the wellbore based on one or more of the received input parameters;

identifying, with the one or more processors, one or more troublesome zones of the wellbore by performing a stress and stability analysis for the wellbore using the generated model based on one or more of the received input parameters to produce one or more stress and stability analysis output parameters;

performing, with the one or more processors, a strengthening analysis for the wellbore using the generated model based on one or more of the received input parameters and one or more of the stress and stability analysis output parameters to produce one or more strengthening analysis output parameters;

performing, with the one or more processors, a mud loss analysis for the wellbore using the generated model based on one or more of the received input parameters and one or more of the strengthening analysis output parameters to produce one or more mud loss analysis output parameters; and drilling the wellbore in the formation with the drilling operation by operating the drilling system using the one or more strengthening analysis output parameters and the one or more mud loss analysis output parameters to strengthen the one or more identified troublesome zones during drilling.

2. The method of claim 1, wherein drilling the wellbore by operating the drilling system comprises drilling the wellbore with a drill string and a drill bit; circulating drilling fluid through the drill string and the drill bit; and mitigating loss of the drilling fluid by performing wellbore strengthening.

3. The method of claim 2, wherein performing the wellbore strengthening comprises sealing one or more existing natural fractures and/or induced fractures with a lost circulation material.

4. The method of claim 3, wherein sealing the one or more fractures comprises determining a dimension of a fracture at a wellbore location and selecting the lost circulation material having a suitable particle size distribution to seal the fracture at the wellbore location.

5. The method of claim 2, wherein performing the wellbore strengthening comprises increasing a fracture gradient at a wellbore location; inducing a fracture at the wellbore location with the increased fracture gradient; and sealing the induced fracture.

6. The method of claim 5, wherein inducing the fracture at the wellbore location with the increased fracture gradient comprises exerting pressure of mud weight that exceeds the fracture gradient at the wellbore location and controlling a size of the induced fracture and an increase in the fracture gradient based on a determined amount of mud weight and/or a type of lost circulation material used at the wellbore location.

7. The method of claim 1, wherein the stress and stability analysis comprises a simple stress and stability analysis and an advanced stress and stability analysis.

8. The method of claim 1, wherein the one or more of the received input parameters used for the stress and stability analysis comprise one or more of temperature parameters, temperature parameters that are time dependent, and mud cake effects.

9. The method of claim 1, wherein the one or more stress and stability analysis output parameters comprise one or more of a safe mud weight window and a fracture length.

10. The method of claim 1, wherein the one or more strengthening analysis output parameters comprise one or more of a fracture width distribution and a fracture reinitiation pressure.

11. The method of claim 1, further comprising updating a mud weight window for the wellbore based on one or more of the strengthening analysis output parameters.

12. The method of claim 1, wherein the one or more mud loss analysis output parameters provide information about one or more of loss of fluid in a natural fracture, loss of fluid in the formation, and loss of fluid in an induced fracture.

13. The method of claim 1, wherein each of the stress and stability, strengthening and mud loss analysis can be run separately or in multiple combinations.

14. The method of claim 1, wherein drilling the wellbore comprises measuring one or more stress and stability output parameters; and performing a calibration procedure by comparing at least one of the one or more stress and stability analysis output parameters to the one or more measured stress and stability analysis parameters to calculate a difference between the at least one of the one or more stress and stability analysis output parameters and the one or more measured stress and stability analysis parameters, and using the calculated difference for calibration purposes of the stress and stability analysis.

15. The method of claim 1, wherein drilling the wellbore comprises measuring one or more strengthening analysis parameters; and performing a calibration procedure by comparing at least one of the one or more strengthening analysis output parameters to the one or more measured strengthening analysis parameters to calculate a difference between the at least one of the one or more strengthening analysis output parameters and the one or more measured strengthening analysis parameters, and using the calculated difference for calibration purposes of the strengthening analysis.

16. The method of claim 1, wherein receiving the input parameters comprises obtaining the one or more input parameters in one or more of a well log, a leak-off test, a mini-fracture test, real-time information for the wellbore being drilled, pre-drilled information from another wellbore, and an assumed value based on available information.

17. The method of claim 1, wherein generating the geomechanical model of the wellbore comprises incorporating a transient thermo-poro-elastic algorithm that takes into account wellbore temperature and/or mudcake effects.

18. The method of claim 1, wherein performing the strengthening analysis for the wellbore comprises simulating a plurality of wellbore strengthening scenarios having one or more of fracture widths, fracture lengths, and lost circulation materials that are different.

19. A drilling system for drilling a wellbore in a formation with a drilling operation, the drilling system comprising:

a memory;

a display device; and a processor operatively coupled to the memory and the display device and adapted to execute program code stored in the memory to:

receive a plurality of input parameters, each input parameter relating to at least one of the wellbore, the formation, and the drilling operation;

generate a geomechanical model of the wellbore based on one or more of the received input parameters;

perform a stress and stability analysis for the wellbore using the generated model based on one or more of the received input parameters to produce one or more stress and stability analysis output parameters;

identify one or more troublesome zones of the wellbore based on the stress and stability analysis;

perform a strengthening analysis for the wellbore using the generated model based on one or more of the received input parameters and one or more of the stress and stability analysis output parameters to produce one or more strengthening analysis output parameters; and perform a mud loss analysis for the wellbore based using the generated model on one or more of the received input parameters and one or more of the strengthening analysis output parameters to produce one or more mud loss analysis output parameters; and operate the drilling system using the one or more strengthening analysis output parameters and the one or more mud loss analysis output parameters to strengthen the one or more identified troublesome zones during drilling of the wellbore in the formation with the drilling operation.

20. The system of claim 19, wherein the one or more mud loss analysis output parameters provide information about one or more of loss of fluid in a natural fracture, loss of fluid in the formation, and loss of fluid in an induced fracture.

21. The system of claim 20, wherein each of the stress and stability, strengthening and mud loss analysis can be run separately or in multiple combinations.

22. The system of claim 19, wherein the stress and stability analysis comprises a simple stress and stability analysis and an advanced stress and stability analysis.

23. The system of claim 19, wherein the one or more of the received input parameters used for the stress and stability analysis comprise one or more of temperature parameters, temperature parameters that are time dependent, and mud cake effects.

24. The system of claim 19, wherein the one or more stress and stability analysis output parameters comprise one or more of a safe mud weight window and a fracture length.

25. The system of claim 19, wherein the one or more strengthening analysis output parameters comprise one or more of a fracture width distribution and a fracture re-initiation pressure.

26. The system of claim 19, wherein the processor is further adapted to execute program code stored in the memory to update mud weight window for the wellbore based on one or more of the strengthening analysis output parameters.

27. The system of claim 19, wherein the processor is further adapted to execute program code stored in the memory to perform a calibration procedure by comparing at least one of the one or more stress and stability analysis output parameters to one or more measured stress and stability analysis parameters to calculate a difference between the at least one of the one or more stress and stability analysis output parameters and the one or more measured stress and stability analysis parameters, and use the calculated difference for calibration purposes.

28. The system of claim 19, wherein the processor is further adapted to execute program code stored in the memory to perform a calibration procedure by comparing at least one of the one or more strengthening analysis output parameters to one or more measured strengthening analysis parameters to calculate a difference between the at least one of the one or more strengthening analysis output parameters and the one or more measured strengthening analysis parameters, and use the calculated difference for calibration purposes.

29. A non-transitory program storage device, readable by a processor and comprising instructions stored thereon to cause one or more processors to:

receive a plurality of input parameters, each input parameter relating to at least one of a wellbore, a formation in which the wellbore is drilled, and a drilling operation used to drill the wellbore with a drilling system;

generate a geomechanical model of the wellbore based on one or more of the received input parameters;

perform a stress and stability analysis for the wellbore using the generated model based on one or more of the received input parameters to produce one or more stress and stability analysis output parameters;

identify one or more troublesome zones of the wellbore based on the stress and stability analysis;

perform a strengthening analysis for the wellbore using the generated model based on one or more of the received input parameters and one or more of the stress and stability analysis output parameters to produce one or more strengthening analysis output parameters; and perform a mud loss analysis for the wellbore using the generated model based on one or more of the received input parameters and one or more of the strengthening analysis output parameters to produce one or more mud loss analysis output parameters; and operate the drilling system using the one or more strengthening analysis output parameters and the one or more mud loss analysis output parameters to strengthen the one or more identified troublesome zones during drilling of the wellbore in the formation with the drilling operation.

30. The non-transitory program storage device of claim 29, wherein the stress and stability analysis comprises a simple stress and stability analysis and an advanced stress and stability analysis.

31. The non-transitory program storage device of claim 29, wherein the one or more of the received input parameters used for the stress and stability analysis comprise one or more of temperature parameters, temperature parameters that are time-dependent, and mudcake effects.

32. The non-transitory program storage device of claim 29, wherein the one or more stress and stability analysis output parameters comprise one or more of a safe mud weight window and a fracture length.

33. The non-transitory program storage device of claim 29, wherein the one or more strengthening analysis output parameters comprise one or more of a fracture width distribution and a fracture re-initiation pressure.

34. The non-transitory program storage device of claim 29, wherein the instructions stored further cause the one or more processors to update a mud weight window for the wellbore based on one or more of the strengthening analysis output parameters.

35. The non-transitory program storage device of claim 29, wherein the one or more mud loss analysis output parameters provide information about one or more of loss of fluid in a natural fracture, loss of fluid in the formation, and loss of fluid in an induced fracture.

36. The non-transitory program storage device of claim 29, wherein each of the stress and stability, strengthening and mud loss analysis can be run separately or in multiple combinations.

* * * * *